US008810486B2

(12) United States Patent
Yumoto

(10) Patent No.: US 8,810,486 B2
(45) **Date of Patent: *Aug. 19, 2014**

(54) ACTIVE-MATRIX DISPLAY DEVICE, AND ACTIVE-MATRIX ORGANIC ELECTROLUMINESCENT DISPLAY DEVICE

(71) Applicant: Sony Corporation, Tokyo (JP)

(72) Inventor: Akira Yumoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/965,939

(22) Filed: Aug. 13, 2013

(65) Prior Publication Data

US 2014/0055441 A1 Feb. 27, 2014

Related U.S. Application Data

(63) Continuation of application No. 13/370,352, filed on Feb. 10, 2012, now Pat. No. 8,558,769, which is a continuation of application No. 11/338,516, filed on Jan. 24, 2006, now Pat. No. 8,120,551, which is a continuation of application No. 10/169,697, filed on Nov. 5, 2002, now Pat. No. 7,015,882.

(30) Foreign Application Priority Data

| | | |
|---|---|---|
| Nov. 7, 2000 | (JP) | 2000-338688 |
| Jul. 31, 2001 | (JP) | 2001-231807 |
| Oct. 18, 2001 | (JP) | 2001-320936 |
| Nov. 5, 2001 | (JP) | 2001-339772 |
| Nov. 7, 2001 | (WO) | JP01/09735 |

(51) Int. Cl.
*G09G 3/30* (2006.01)

(52) U.S. Cl.
USPC ..... 345/76; 345/77; 345/204; 345/690; 315/169.1; 315/169.3

(58) Field of Classification Search
USPC ..... 345/76–83, 98–100, 204, 690; 315/169.1–169.4
See application file for complete search history.

(56) References Cited

U.S. PATENT DOCUMENTS

| | | | |
|---|---|---|---|
| 3,909,788 | A | 9/1975 | Kaelin et al. |
| 5,594,463 | A | 1/1997 | Sakamoto |

(Continued)

FOREIGN PATENT DOCUMENTS

| | | |
|---|---|---|
| EP | 1 054 410 | 11/2000 |
| JP | 62-122488 | 6/1987 |
| JP | 63-179336 | 7/1988 |
| JP | 07-036409 | 2/1995 |
| JP | 08-234683 A | 9/1996 |
| JP | 09-114423 | 5/1997 |
| JP | 10-282931 | 10/1998 |

(Continued)

*Primary Examiner* — Jennifer Nguyen
(74) *Attorney, Agent, or Firm* — Rader, Fishman & Grauer PLLC

(57) ABSTRACT

An active-matrix display device employs current-programmed-type pixel circuits and performs the writing data to each of pixels on a line-by-line basis. The active-matrix display device having a matrix of current-programmed-type pixel circuits includes a data line driving circuit 15 formed of m current driving circuits (CD) 15-1 to 15-m arranged-corresponding to respective data lines 13-1 to 13-m. The data line driving circuit (CD) 15-1 to 15-m holds image data (luminance data herein) in the form of voltage, and then converts the voltage of the image data into a current signal. The current signal is then fed to the data lines 13-1 to 13-m at a time. The image information is thus written on the pixel circuits 11.

28 Claims, 35 Drawing Sheets

(56) References Cited

U.S. PATENT DOCUMENTS

| | | | | |
|---|---|---|---|---|
| 5,818,406 | A * | 10/1998 | Tsuchi et al. | 345/89 |
| 5,952,789 | A | 9/1999 | Stewart et al. | |
| 5,966,110 | A * | 10/1999 | Van Zalinge | 345/82 |
| 6,091,203 | A * | 7/2000 | Kawashima et al. | 315/169.3 |
| 6,222,357 | B1 | 4/2001 | Sakuragi | |
| 6,246,180 | B1 | 6/2001 | Nishigaki | |
| 6,501,466 | B1 | 12/2002 | Yamagishi et al. | |
| 6,686,699 | B2 | 2/2004 | Yumoto | |
| 6,747,625 | B1 | 6/2004 | Han et al. | |
| 6,774,574 | B1 | 8/2004 | Koyama | |
| 6,781,155 | B1 | 8/2004 | Yamada | |
| 7,015,882 | B2 | 3/2006 | Yumoto | |

FOREIGN PATENT DOCUMENTS

| | | | |
|---|---|---|---|
| JP | 10-312177 | | 11/1998 |
| JP | 10-319908 | | 12/1998 |
| JP | 11-202294 | | 7/1999 |
| JP | 11-282419 | | 10/1999 |
| JP | 11-338561 | | 12/1999 |
| JP | 2000-081920 | A | 3/2000 |
| JP | 2000-105574 | | 4/2000 |
| JP | 2000-122607 | A | 4/2000 |
| JP | 2000-221942 | | 8/2000 |
| JP | 2000-329798 | | 11/2000 |
| JP | 2002-152565 | A | 5/2002 |
| WO | WO-98/48403 | | 10/1998 |

* cited by examiner

FIG.22
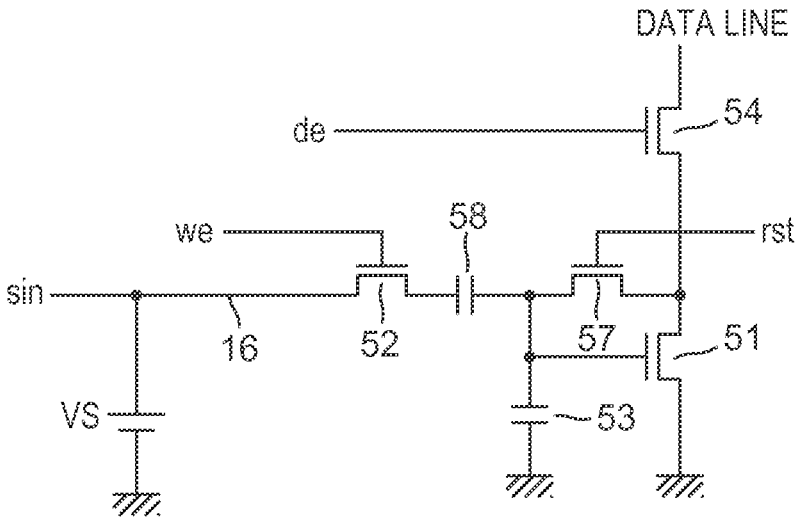
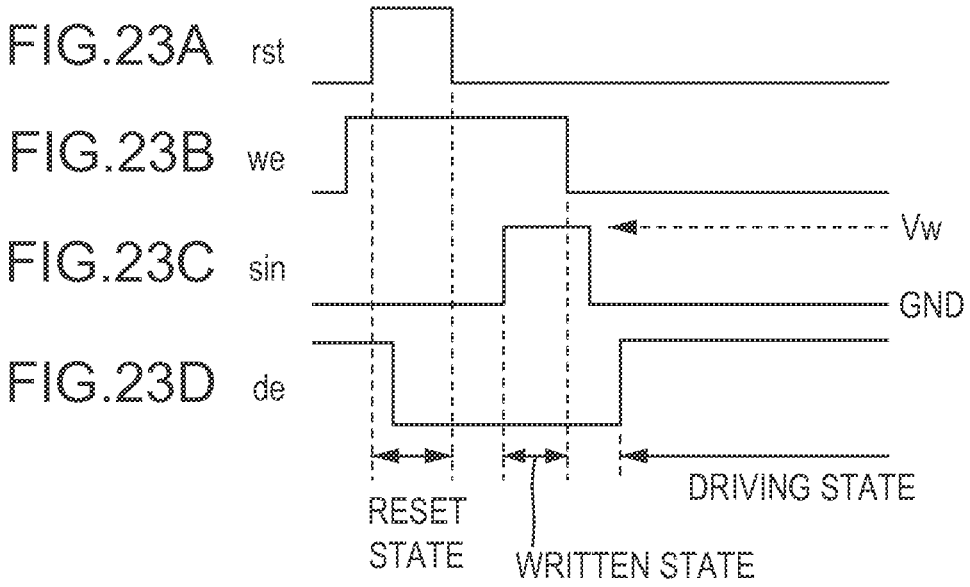

ACTIVE-MATRIX DISPLAY DEVICE, AND ACTIVE-MATRIX ORGANIC ELECTROLUMINESCENT DISPLAY DEVICE

CROSS REFERENCES TO RELATED APPLICATIONS

This is a Continuation Application of the patent application Ser. No. 13/370,352, filed Feb. 10, 2012, which is a Continuation Application of patent application Ser. No. 11/338,516, filed Jan. 24, 2006, now U.S. Pat. No. 8,120,551, issued Feb. 21, 2012, which is a Continuation Application of patent application Ser. No. 10/169,697, now U.S. Pat. No. 7,015,882, issued Mar. 21, 2006, which claims priority from Japanese Patent Application No.: 2000-338688, filed Nov. 7, 2000, Japanese Patent Application No.: 2001-231807, filed Jul. 31, 2001, Japanese Patent Application No.: 2001-320936, filed Oct. 18, 2001, Japanese Patent Application No.: 2001-339772, filed Nov. 5, 2001 and National Stage Application No.: PCT/JP05/011884, filed Nov. 7, 2001, the entire contents of which being incorporated herein by reference.

TECHNICAL FIELD

The present invention relates to an active-matrix display device which has an active element on a per pixel basis and controls a display thereof on a per pixel basis by the active element. More particularly, the present invention relates to an active-matrix display device which employs, as a display element, an electrooptical element that changes the luminance level thereof in response to a current flowing therethrough, and an active-matrix organic electroluminescent (EL) display device which employs, as an electrooptical element, an organic electroluminescent element.

BACKGROUND ART

A display device, using for example, liquid-crystal cells as display elements, includes a matrix of numerous pixels, and controls light intensity on a per pixel basis in response to image information to be displayed, thereby presenting a display on the pixels. An organic EL display employing organic EL elements is also driven in the same way.

However, the organic EL display, which is a self-emitting-type display using an emitting element as a display pixel, presents advantages of a high visibility of an image, compared with that provided by a liquid-crystal display, of requiring no backlight, and of a high response speed. The organic EL display is different from the liquid-crystal display in that the organic EL display is of a current control type while the liquid-crystal display is of a voltage control type. Specifically, luminance of the organic EL element is controlled by a current flowing therethrough.

A simple (passive) matrix method and an active-matrix method are available to drive the organic EL display in the same as a liquid-crystal display. Although being simple in structure, the former method cannot be used in a large-scale and high-definition display. For this reason, active-matrix displays are now actively being developed in which a current flowing through an emitting element in each pixel is controlled by an active element (a thin-film transistor (TFT)) arranged within a pixel.

FIG. 33 shows a pixel circuit (a circuit for a unit pixel) in a conventional active-matrix organic EL display (disclosed in U.S. Pat. No. 5,684,365 and Japanese Unexamined Patent Application Publication No. 8-234683).

Referring to FIG. 33, the conventional pixel circuit includes an organic EL element 101 with the anode thereof connected to a positive power source Vdd, a TFT 102 with the drain thereof connected to the cathode of the organic EL element 101 and the source thereof grounded, a capacitor 103 connected between the gate of the TFT 102 and ground, and a TFT 104 with the drain thereof connected to the gate of the TFT 102, with the source thereof connected to a data line 106, and with the gate thereof connected to a scanning line 105.

The organic EL element has a rectification feature, in many cases, so is sometimes referred to as an OLED (organic light emitting diode). Accordingly, the OLED is represented by a diode symbol in FIG. 33 and other figures. However, in the discussion that follows, rectification features are not a requirement.

The pixel circuit thus constructed operates as follows. Now, the scanning line 105 is in a selection state (at a high level, here) and the data line 106 is supplied with a writing potential Vw. The TFT 104 is turned on, charging or discharging the capacitor 103, and thereby the potential of the gate of the TFT 102 becomes the writing potential Vw. When the scanning line 105 is driven to a deselection potential (at a low level, here), the scanning line 105 is electrically disconnected from the TFT 102, but the gate voltage of the TFT 102 is reliably maintained by the capacitor 103.

A current flowing through the TFT 102 and the OLED 101 responds to a value of gate-source voltage Vgs of the TFT 102. The OLED 101 continuously emits light at a luminance level determined by the current value responsive to the gate-source voltage Vgs. In the following discussion, a "writing operation" refers to an operation to transfer luminance information, given to the data line 106, to within a pixel when the scanning line 105 is selected. As described above, in the pixel circuit shown in FIG. 33, once the writing operation is performed at the writing potential VW, the OLED 101 continuously emits light at a constant luminance level.

Such pixel circuits (hereinafter also referred to as pixels) 111 are arranged in a matrix as shown in FIG. 34. A scanning line driving circuit 113 successively selects scanning lines 112-1 through **112-*n* while a data line driving circuit (a voltage driver) 114 of A voltage driving type writes data on data lines 115-1 through 115-*m***. The active-matrix display device (the organic EL display) is thus driven. The active-matrix display device here includes a matrix of n rows by m columns of pixels. In this case, the number of data lines is m, while the number of scanning lines is n.

In the passive-matrix display device, each emitting element emits light only at the moment it is selected. In the active-matrix display device, an emitting element continuously emits light even after the end of data writing. For this reason, the active-matrix display device outperforms the passive-matrix display device particularly in the field of large-scale and high-definition displays, because a low peak luminance and a low peak current of each light emitting element work in the active-matrix display device.

In the active-matrix organic EL display device, an insulated gate thin-film field-effect transistor (TFT) formed on a glass substrate is typically used as an active element. Since amorphous silicon or polysilicon used in the formation of the TFT generally suffers from poor crystallinity, and a poor controllability in the conductive mechanism thereof, a resulting TFT is subject to large variations in the characteristics thereof.

When the polysilicon TFT is formed on a relatively large-sized glass substrate, crystallization is usually performed using laser annealing subsequent to the formation of an amorphous silicon layer to control a thermal deformation of the glass substrate. However, it is difficult to uniformly irradiate a relatively large-sized glass substrate with laser energy, and the polysilicon suffers from localized variations in the crystallization state thereof. As a result, the threshold voltage Vth of the TFTs formed on the same substrate vary within a range of several hundreds of mV, in certain cases, 1V or more.

In this case, even if the same potential VW is written on different pixels, the threshold value Vth of the TFT varies from pixel to pixel. The current Ids flowing through the OLED greatly varies from pixel to pixel, and the display device cannot be expected to present a high-quality image. Variations take place not only in the threshold value Vth but also in the mobility μ of the carrier.

The inventor of the present invention has proposed a current-programmed-type pixel circuit as shown in FIG. 35 to resolve the above problem (reference is made to International Publication No. WO01-06484).

A current-programmed-type pixel circuit includes an OLED 121 with the cathode thereof connected to a negative power source Vss, a TFT 122 with the drain thereof connected to the anode of the OLED 121, and with the source thereof connected to ground, which serves as a reference potential point, a capacitor 123 connected between the gate of the TFT 122 and ground, a TFT 124 with the gate thereof connected to the gate of the TFT 122 and with the source thereof grounded, a TFT 125 with the drain thereof connected to the drain of the TFT 124, with the source thereof connected to a data line 128, and with the gate thereof connected to a scanning line 127, and a TFT 126 with the drain thereof connected to each of the gates of the TFT 122 and the TFT 124, with the source thereof connected to each of the drains of the TFT 124 and the TFT 125, and with the gate thereof connected to the scanning line 127.

In this circuit, the TFT 122 and the TFT 124 are PMOS field-effect transistors, and the TFT 125 and the TFT 126 are NMOS type. FIGS. 36A to 36C are timing diagrams of the pixel circuit in the driving operation thereof.

The pixel circuit shown in FIG. 35 is different from that shown in FIG. 33. Luminance data is given in the form of voltage in the pixel circuit shown in FIG. 33, while the same data is given in the form of current in the pixel circuit shown in FIG. 35. The operation of the circuit shown in FIG. 35 will now be discussed.

To write the luminance information, the scanning line 127 is set to a selection state and a current Iw corresponding to the luminance information flows through the data line 128. The current Iw flows through the TFT 124 via the TFT 125. The gate-source voltage generated between the gate and the source of the TFT 124 is referred to as Vgs. During the writing operation, the TFT 124 operates in the saturation region thereof because the TFT 126 shorts the gate and the drain of the TFT 124.

The following well-known equation of the MOS transistor holds.

$$Iw=\mu 1Cox1W1/L1/2(Vgs-Vth1)^2 \quad (1)$$

In equation (1), Vth1 is a threshold value of the TFT 124, μ1 is the mobility of the carrier, Cox1 is the gate capacitance per unit area, W1 is the channel width, and L1 is the channel length.

A current flowing through the OLED 121 is referred to as Idrv, the current Idrv is controlled the value by the TFT 122 connected in series with the OLED 121. In the pixel circuit shown in FIG. 35, the gate-source voltage of the TFT 122 agrees with Vgs in the equation (1). On the assumption that the TFT 122 operates in the saturation region thereof, the following equation (2) holds.

$$Idrv=\mu 2Cox2W2/L2/2(Vgs-Vth2)^2 \quad (2)$$

The condition under which the MOS transistor operates in the saturation region thereof is expressed by the following equation (3).

$$|Vds|>|Vgs-Vth| \quad (3)$$

The symbols in the equations (2) and (3) are identical to those used in the equation (1). Since the TFT 124 and the TFT 122 are formed closely in a small area within the pixel, in practice, μ1=μ2, Cox1=Cox2, and Vth1=Vth2. From the equations (1) and (2), $$Idrv/Iw=(W2/W1)/(1.2/1.1) \quad (4)$$

Even if the mobility p of the carrier, the gate capacitance Cox per unit area, and the threshold value Vth are varied within a panel, or from panel to panel, the luminance of the OLED 121 is precisely controlled because the current Idrv flowing through the OLED 121 is accurately proportional to the writing current Iw. For example, if the transistors are designed with the conditions of W2=W1 and L2=L1 satisfied, Idrv/Iw=1. Specifically, the writing current Iw equals the current Idrv flowing through the OLED 121 regardless of variations in the TFT characteristics.

In the active-matrix display device, the writing of the luminance data to each pixel is basically performed on a scanning line by scanning line basis. For example, in a liquid-crystal display using amorphous silicon TFTs, the writing of the luminance data is performed on the pixels arranged on a selected scanning line at a time basis. The writing on a per scanning line basis is now referred to a line-by-line writing operation.

In the display device working on a line at a time writing operation, the data line driver is manufactured using a typical monolithic semiconductor technology in a manufacturing process different from the manufacturing process of the pixel circuit (TFT) in the display panel. A data line driving circuit having reliable characteristics is thus easily manufactured. On the other hand, since it is necessary to have a plurality of data line drivers, the number of which is equal to the number of data lines in the display device, the entire system becomes bulky in size and costly. To manufacture a display device having a large number of pixels or pixels arranged in a narrow pitch, the number of lines and connections of a display panel with the drivers external to the panel become large. The effort to develop a large-scale and high-definition display device is subject to a limitation in terms of the reliability of the connections and the wiring pitch.

The "drivers external to the panel" are literally arranged outside the display panel (the glass substrate), and are occasionally connected to the panel using a flexible cable. The drivers external to the panel are sometimes mounted on the panel (the glass substrate) using the TAB (Tape Automated Bonding) technology. The phrase "drivers external to the panel" is and will be used in the context of the above two arrangements.

With its high transistor driving performance, the liquid-crystal display using the polysilicon TFT writes data on a single pixel for a short period of time, and a dot-by-dot writing operation is typically adopted. FIG. 37 shows the construction of a display device working on a dot-by-dot writing operation and FIGS. 38A to 38F are timing diagrams of the display device. Note that in FIG. 37, the same parts as those of FIG. 34 are indicated by the same symbols as those of FIG. 34.

Referring to FIG. 37, horizontal switches HSW1-SHWm are respectively connected between the ends of data lines 115-1 through **115-*m* and a signal input line 116. The horizontal switches HSW1-HSWm are turned on and off by selection pulses we1-wem that are successively output from a horizontal scanner (HSCAN) 117. The horizontal switches HSW1-HSWm and the horizontal scanner 117 are formed of TFTs, and are manufactured in the same manufacturing process as that of a pixel circuit 111**.

The horizontal scanner 117 receives a horizontal start pulse hsp and a horizontal clock hck. Referring to FIGS. 38A to 38F, subsequent to the input of the horizontal start pulse hsp, the horizontal scanner 117 successively generates the selection pulses we1-wem to select the horizontal switches HSW1-HSWm, in response to the transition of the horizontal clock hck (the rising edge or the falling edge of the horizontal clock hck).

Each of the horizontal switches HSW1-HSWm becomes conductive when the corresponding one of the selection pulses we1-wem is fed, thereby transferring image data (a voltage value) sin to each of the data lines 115-1 through **115-*m* through the signal input line 116. In this way, the writing of the data on the pixels of the scanning line selected by the scanning line driving circuit 113 is performed on a dot-by-dot basis. The voltage given to the data lines 115-1 through 115-*m* is held by a capacitive component such as a stray capacity of each of the data lines 115-1 through 115-*m*** even after the horizontal switches HSW1-HSWm becomes non-conductive.

When m clocks of the horizontal clock hck are fed, the data is written on all pixels on the selected scanning line. Since the display device working on a dot-by-dot basis uses the single signal input line 116 on a time sharing manner, the number of connection points between the display panel and the data line drivers (a circuit for feeding the image data sin) external to the display panel is small in number, and the number of the external drivers is accordingly small.

When the current-programmed-type pixel circuit shown in FIG. 35 is adopted as the pixel circuit, however, it is impossible to normally write the data on the pixels 111 in the display device shown in FIG. 37. The reason for this will be discussed.

When the signal input line 116 is driven by a current source with a particular horizontal switch HSW being selected and conductive in FIG. 37, a normal current writing is performed on a pixel on a data line of the selected horizontal switch HSW. When the current writing starts on another data line with the horizontal clock hck input to the horizontal scanner 117 thereafter, the horizontal switch HSW, which was selected until then, becomes conductive at the moment of writing. The current flowing into the corresponding data line becomes zero.

To perform the normal writing, a predetermined writing current needs to be fed to all pixels on the scanning line when the scanning lines are switched from the selection state to the deselection state thereof. In other words, when the current-programmed-type pixel circuit is adopted, the data writing on the pixels needs to be performed on a line-by-line basis. Referring to FIG. 39, a data line driver 118 arranged external to the display panel needs to be used to concurrently write the data-onto the pixels on the selected scanning line.

The circuit shown in FIG. 39 is essentially identical in construction to the circuit of a line-by-line driving method shown in FIG. 34. As a result, the circuit shown in FIG. 39 has the problem that the number of current drivers CD1-CDm forming the data line driving circuit 118 and the number of connection points between the current drivers and the display panel increase.

DISCLOSURE OF THE INVENTION

Accordingly, it is an object of the present invention to provide an active-matrix display device and an active-matrix organic EL display device which can realize a normal current writing operation with connection points between a display panel and external data liner drivers reduced in number with a current-programmed-type pixel circuit incorporated.

An active-matrix display device of the present invention includes a display section including a matrix of pixel circuits of a current-programmed-type which writes image information by a current, a plurality of scanning lines for selecting each pixel circuit, and a plurality of data lines which supplies each pixel circuit with the image information, and a driving circuit which holds the image information for each pixel circuit in the form of voltage, and then writes the image information onto each of the plurality of data lines after converting the voltage image information in the form of voltage into the information in the form of current.

Even if active elements in the current-programmed-type pixel circuit varies in characteristics in the above-referenced active-matrix display device, luminance of the display element is precisely controlled because the current flowing through the display element is accurately proportional to the writing current. The driving circuit holds image information, and then gives the image information to the data lines in the form of current. In this way, the driving circuit writes the image information on pixel circuits on a line-by-line basis.

BRIEF DESCRIPTION OF THE DRAWINGS

FIG. 22 is a circuit diagram showing an eighth circuit example of the data line driver;

FIGS. 23A to 23D are timing diagrams illustrating the circuit operation of the eighth circuit example of the data line driver;

BEST MODE FOR CARRYING OUT THE INVENTION

Figure 1:
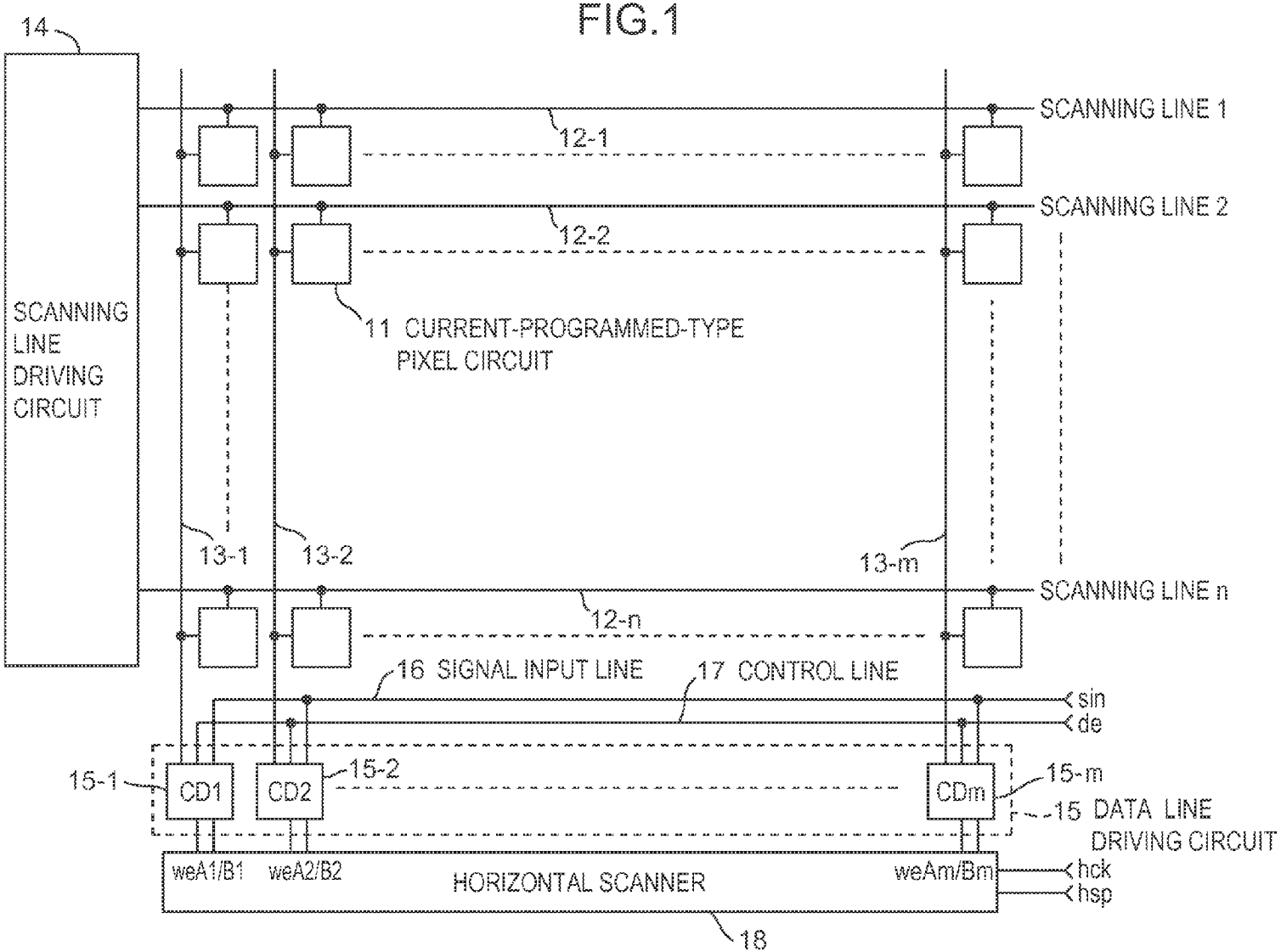
FIG. 1 is a block diagram showing an active-matrix display device according to a first embodiment of the present invention.
Figures 2A, 2B, 2C, 2D, 2E, 2F, 2G, 2H, 2I, 2J, 2K:
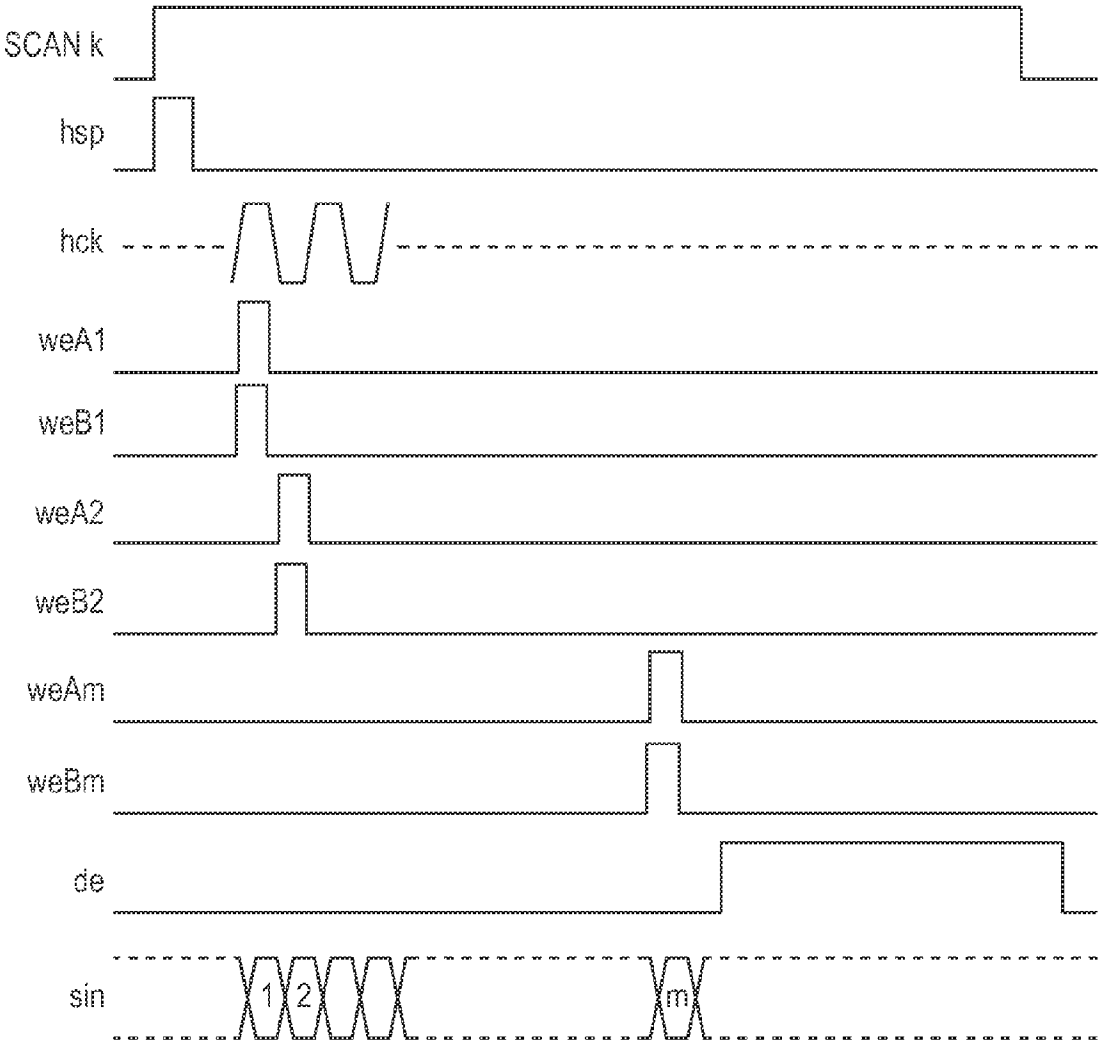
FIGS. 2A to 2K are timing diagrams for explaining the circuit operation of the active-matrix display device according to the first embodiment.

Referring to the drawings, the embodiments of the present invention will now be discussed.

First Embodiment

FIG. 1 is a block diagram showing an example of the configuration of an active-matrix display device according to a first embodiment of the present invention. As shown in FIG. 1, a plurality of pixel circuits 11 is arranged in a matrix, forming a display area (a display unit). The display area includes a matrix of n rows by m columns of pixels. The display area includes n scanning lines 12-1 through **12-*n* for selecting each pixel (each pixel circuit) and m data lines 13-1 through 13-*m*** for supplying each pixel with image data such as luminance data.

A scanning line driving circuit 14 for selecting the scanning lines 12-1 through **12-*n* and a data line driving circuit 15 for driving the data lines 13-1 through 13-*m* are arranged external to the display area. The scanning line driving circuit 14 is formed of a shift register, for example, and output terminals of stages thereof are respectively connected to the ends of the scanning lines 12-1 through 12*n*. As will be discussed later, the data line driving circuit 15 is composed of m current-programmed-type current drivers (CDs) 15-1 through 15-*m*. The output terminals of the current-programmed-type current drivers (hereinafter simply referred to as current drivers) 15-1 through 15-*m* are respectively connected to the ends of the data lines 13-1 through 13-*m***.

The current drivers **15-*i* through 15-*m* in the data line driving circuit 15 are supplied with the image data (the luminance data) sin from the external via a signal input line 16 while being supplied with a driving control signal de from the external via a control line 17. The current drivers 15-1 through 15-*m* respectively arranged for the data lines 13-1 through 13-*m* share the single signal input line 16, and receives the image data through the signal input line 16 in a time sharing manner. The current drivers 15-1 through 15-*m* are supplied with two series of writing control signals weA1-weAm and weB1-weBm by a horizontal scanner (HSCAN) 18**.

The horizontal scanner 18 receives a horizontal start pulse hsp and a horizontal clock hck. Referring to FIGS. 2A to 2K, the horizontal scanner 18 is composed a shift register, for example, and, subsequent to the reception of the horizontal start pulse hsp, the horizontal scanner 18 successively generates the writing control signals weA1-waAm and weB1-weBm in response to the level transition of the horizontal clock hck (the rising edge and the falling edge of the horizontal clock hck). The writing control signals weA1-weAm are respectively slightly delayed from the writing control signals weB1-weBm.

Figure 35:
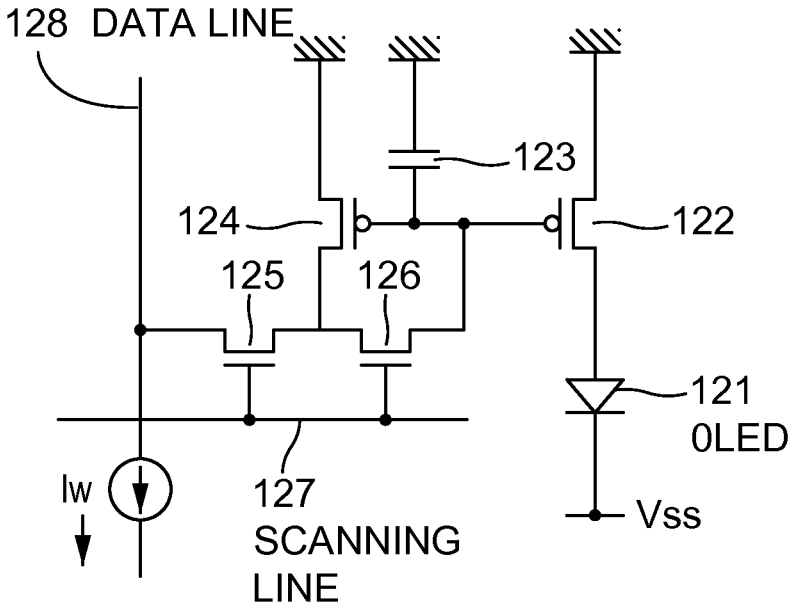
FIG. 35 is a circuit diagram showing the configuration of a current-programmed-type pixel circuit of a conventional art.
Figures 36A, 36B, 36C:
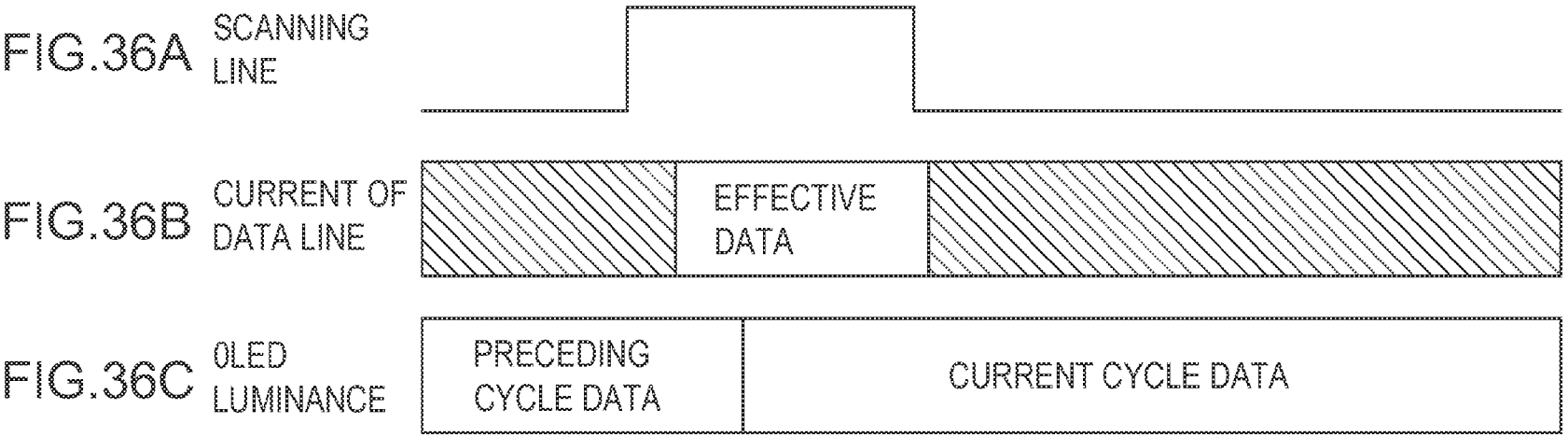
FIGS. 36A to 36C are timing diagrams for explaining the circuit operation of the conventional current-programmed-type pixel circuit.
Figure 37:
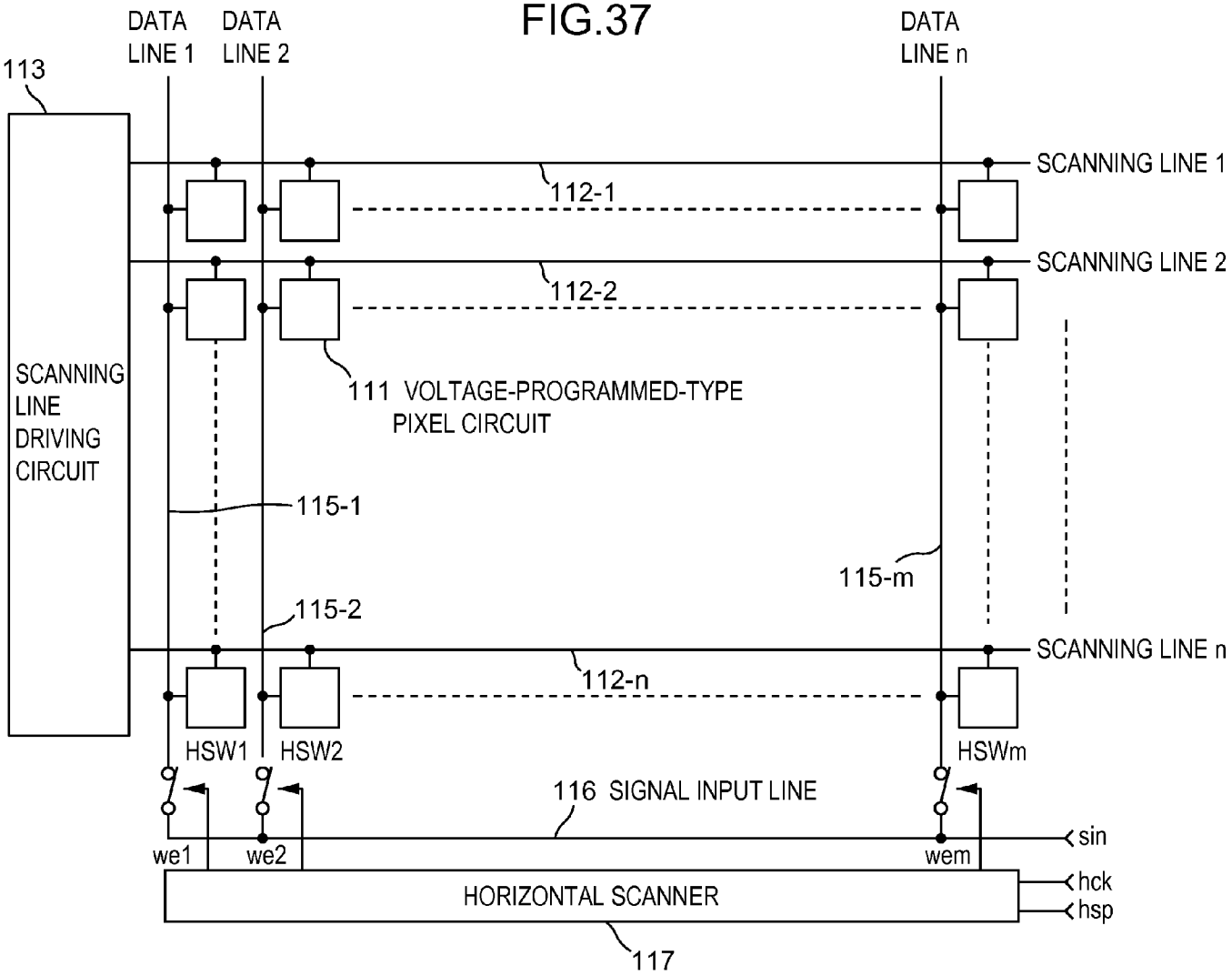
FIG. 37 is a block diagram showing an example of the configuration of an active-matrix display device working on a dot-by-dot basis.
Figures 38A, 38B, 38C, 38D, 38E, 38F:
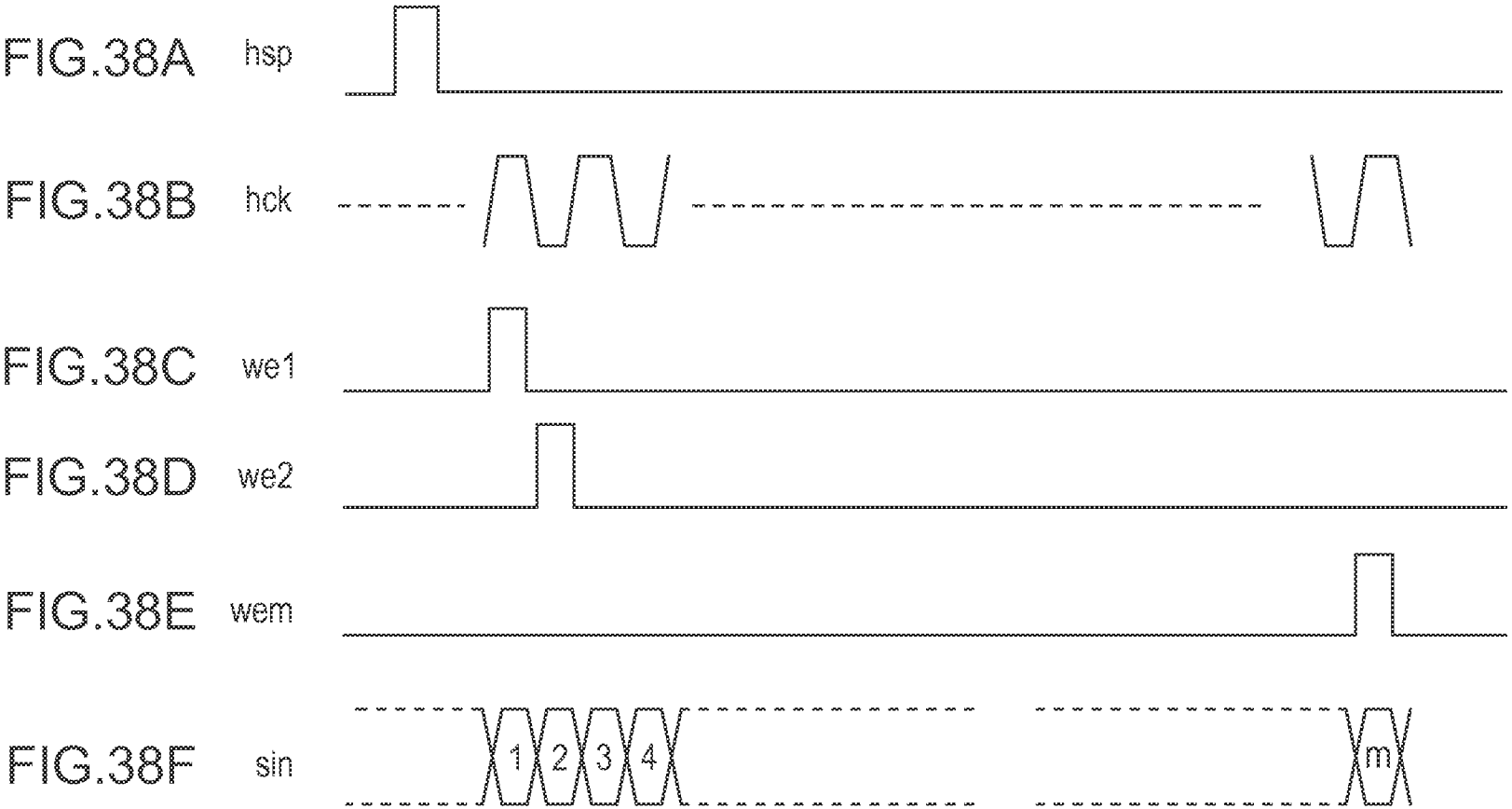
FIGS. 38A to 38F are timing diagrams for explaining the circuit operation of an active-matrix display device working on a dot-by-dot driving method.
Figure 39:
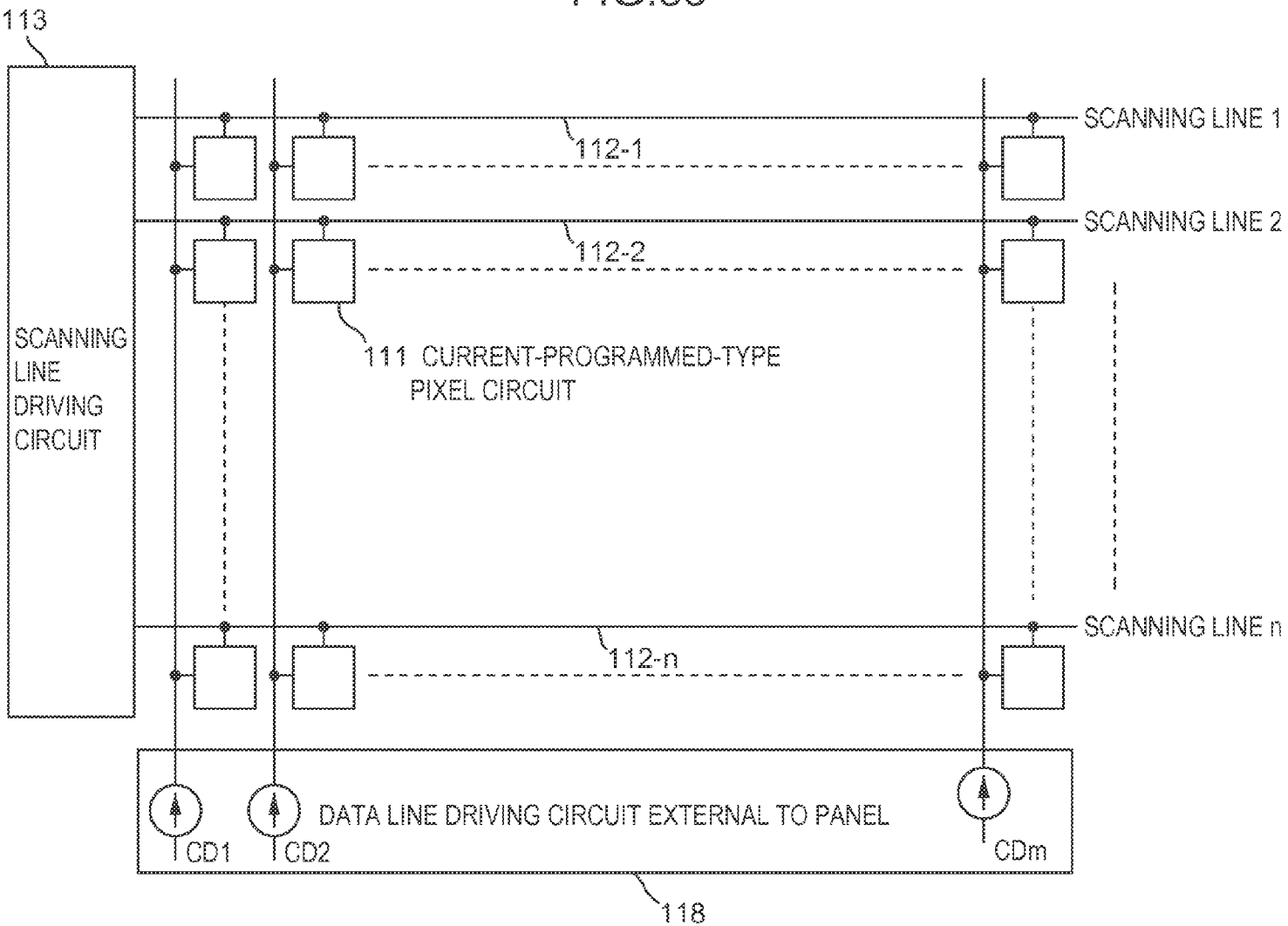
FIG. 39 is a block diagram showing an example of the configuration of an active-matrix display device employing a current-programmed-type pixel circuit.

The active-matrix display device having the above configuration according to the first embodiment employs the current-programmed-type pixel circuit shown in FIG. 35 as the pixel circuit 11, for example.

The current-programmed-type pixel circuit includes an organic EL element (OLED) with luminance level thereof controlled by the current, as a display element of the pixel circuit 11, four TFTs (insulated gate thin-film field-effect transistors), and one capacitor. The luminance data is given in the form of current. The pixel circuit 11 is not limited to the one shown in FIG. 35, and any pixel circuit is acceptable as long as it is of a current-programmed-type.

Figure 3:
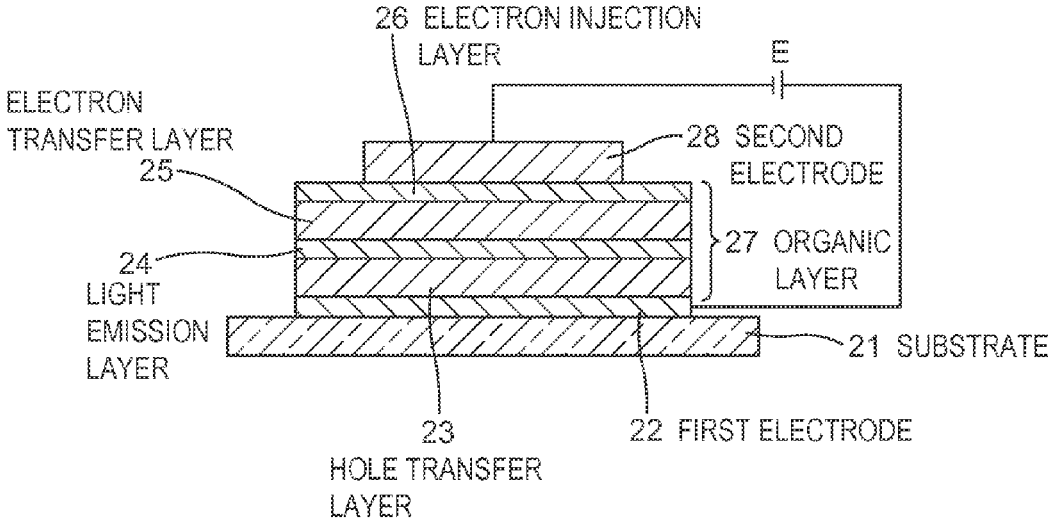
FIG. 3 is a cross-sectional view of an example of the configuration of an organic EL element.

The construction of one example of the organic EL element will now be discussed. FIG. 3 is a cross-sectional view of an organic EL element. The organic EL element shown in FIG. 3 includes a first electrode 22 (an anode for example), manufactured of an electrically conductive, transparent layer, on a substrate 21 manufactured of transparent glass, an organic layer 27, including a hole transfer layer 23, a light emission layer 24, an electron transfer layer 25, and an electron injection layer 26, successively formed on the first electrode 22, and a second electrode 28 (such as a cathode), of a metal, formed on the organic layer 27. By applying a direct current E between the first electrode 22 and the second electrode 28, the light emission layer 24 emits light in the course of recombination of holes and electrodes therewithin.

The pixel circuit including an organic EL device (OLED) typically employs a TFT as an active element formed on a glass substrate. The scanning line driving circuit 14 is formed of circuit elements such as TFTs on the glass substrate (a display panel) bearing the pixel circuit. The current drivers 15-1 through **15-*m* may also be produced of circuit elements such as TFTs on the same display panel (the glass substrate). It is not a requirement that the current drivers 15-1 through 15-*m* be formed on the display panel. The current drivers 15-1 through 15-*m*** may be arranged external to the panel.

First Circuit Example

Figure 4:
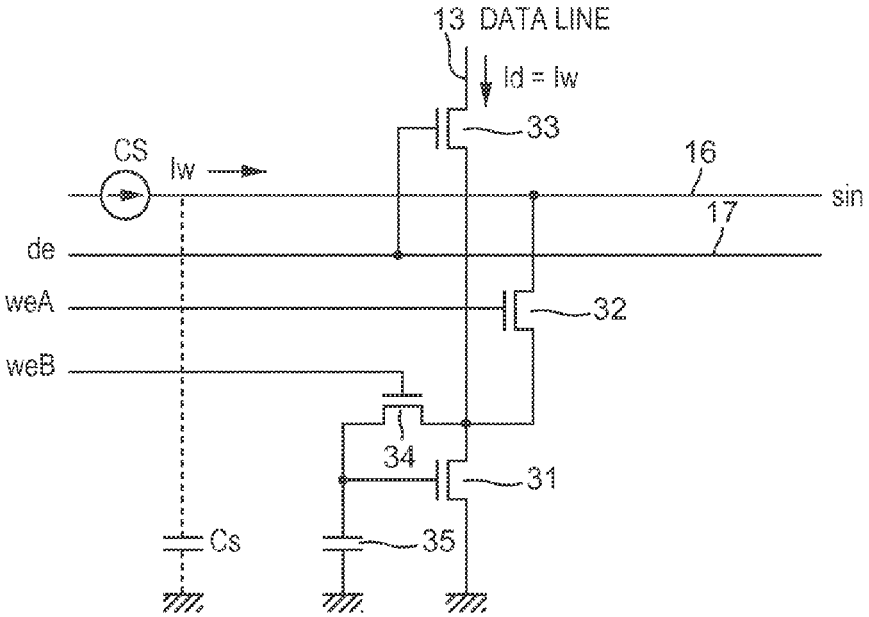
FIG. 4 is a circuit diagram showing a first circuit example of the data line driver.
Figures 5A, 5B, 5C, 5D:
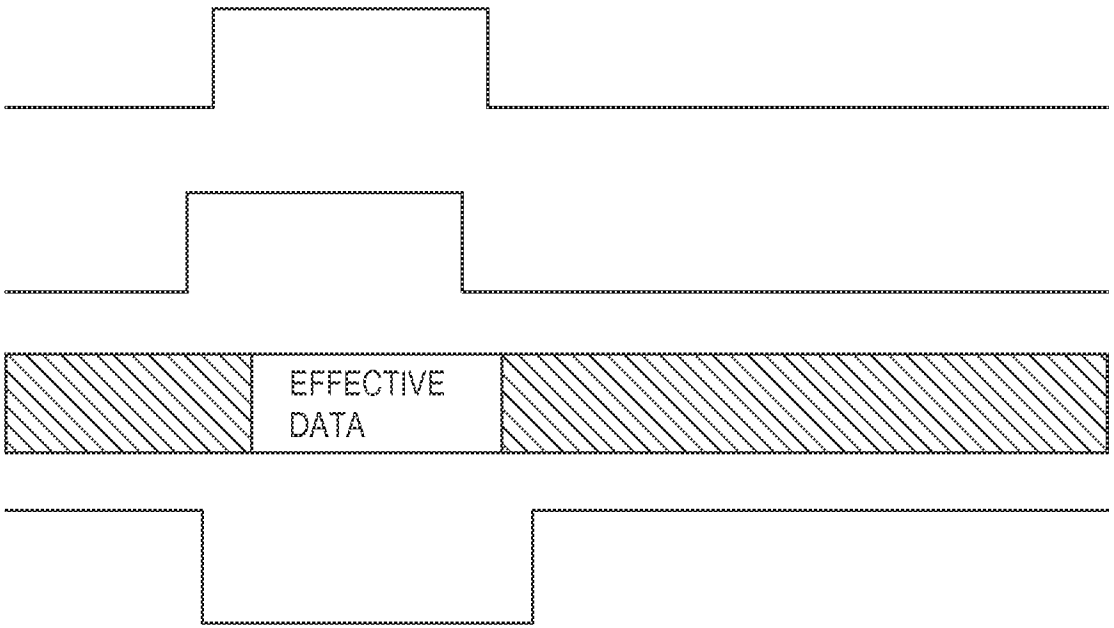
FIGS. 5A to 5D are timing diagrams illustrating the driver.

FIG. 4 is a circuit diagram specifically showing one of the current drivers 15-1 through **15-*m* forming the data line driving circuit 15. All the current drivers 15-1 through 15-*m*** are identical to each other in configuration.

The current driver in the first embodiment includes four TFTs 31-34, and one capacitor 35. In this circuit example, all the TFTs 31-34 are manufactured of NMOS transistors, but the present invention is not limited this type of transistor.

In FIG. 4, the TFT 31 with the source thereof grounded functions as a converting unit. The drain of the TFT 31 are the sources of the TFT 32 and the TFT 33, and the drain of the TFT 34. The TFT 32 is a first switching element with the drain thereof connected to the signal input line 16, and with the gate thereof receiving a first writing control signal weA. The TFT 33 with the drain thereof connected to a data line 13 functions as a driving unit, and receives, at the gate thereof; a driving control signal de through the control line 17. The TFT 34, with the source thereof connected to the gate of the TFT 31, functions as a second switching element, and receives, at the gate thereof, a second writing control signal weB. The capacitor 35, forming a holding unit, is arranged between the node of the gate of the TFT 31 and the source of the TFT 34 and ground.

Next, the circuit operation of the current driver thus constructed will now be discussed, referring to waveform diagrams of FIGS. 5A to 5D.

To perform a writing operation to the current driver, both the first writing control signal weA and the second writing control signal weB are set to be in a selection state. Here, the selection state is that both signals are at a high-level state. The driving control signal de is in a deselection state (at a low level here). The writing current Iw flows into the TFT 31 from the source of the TFT 32 by connecting the current source CS of the writing current Iw to the signal input line 16.

Since the TFT 34 shorts the gate and the drain of the TFT 31, the equation (3) holds, and the TFT 31 operates in the saturation region thereof. The gate-source voltage Vgs is generated between the gate and the source of the TFT 31 as expressed in the following equation (5).

$$Iw=\mu Cox\ W/L/2(Vgs-Vth)^2 \quad (5)$$

where Vth is the threshold value of the TFT 31, μ is the carrier mobility, Cox is the gate capacitance per unit area, W is the channel width, and the L is the channel length.

Next, the first writing control signal weA and the second writing control signal weB are set to be in a deselection state. Specifically, the second writing control signal weB is driven low, turning off the TFT 34. The voltage Vgs generated between the gate and the source of the TFT 31 is held by the capacitor 35. The first writing control signal weA is then driven low, turning off the TFT 32, and thereby electrically isolating the current driver from the current source CS. The current source CS is then able to perform a writing operation on another current driver. The TFT 33 drives the data line 13 based on the voltage Vgs held in the capacitor 35.

At the end of the writing to the current driver, the TFT 34 is first turned off, and the TFT 32 is then turned off. By turning off the TFT 34 prior to the TFT 32, the luminance data is reliably written. The data driven by the current source CS has to be effective when the second writing control signal weB is in a deselection state. Thereafter, the data can be at any level (for example, can be write data to the next current driver).

When the driving control signal de is in a selection state (at a high level here), the current flowing through TFT 31 operating in the saturation region thereof is expressed by the following equation (6).

$$Id=\mu CoxW/L/2(Vgs-Vth)^2 \quad (6)$$

This current flows through the data line 13, and agrees with the above-mentioned writing current Iw.

The circuit shown in FIG. 4 converts the luminance data sin written in the form of current into a voltage, and holds the voltage in the capacitor 35, and drives the data line 13 with a current substantially equal to the written current in response to the voltage held in the capacitor 35 even after the writing. In this operation, the absolute values of the carrier mobility μ and the threshold value Vth in the equations (5) and (6) are not a problem. In other words, the circuit shown in FIG. 4 is able to drive the data line 13 with the current accurately equal to the written current regardless of variations in the TFT characteristics.

The active-matrix display device shown in FIG. 1 according to the first embodiment now includes the current-programmed-type pixel circuit shown in FIG. 35 as the pixel circuit 11, and the current-programmed-type drivers shown in FIG. 4 as the current drivers 15-1 through **15-*m*. The operation of the active-matrix display device shown in FIG. 1 will now be discussed, with reference to a timing diagram shown in FIGS. 2A to 2**K.

As explained above, subsequent to the input of the horizontal start pulse hsp, the horizontal scanner 18 successively generates the first and second series writing control signals weA1-weAm and weB1-weBm in response to the level transition of the horizontal clock hck. The writing control signals weA1-weAm are respectively slightly delayed from the writing control signals weB1-weBm. The luminance data sin is input in synchronization with the writing control signals weA1-weAm and weB1-weBm from the signal input line 16 in the form of current.

When m clocks of the horizontal clock hck are input, the luminance data sin is written on the m current drivers 15-1 through **15-*m*. During the data writing, the driving control signal do remains in a deselection state. At the moment the writing of all current drivers 15-1 through 15-*m* is complete, the driving control signal de is set to a selection state, and the data lines 13-1 through 13-*m* are thus driven. Since a k-th scanning line 12-*k* is selected during the selection state of the driving control signal de, a line-by-line writing operation is performed on the pixel circuits 11 connected to the scanning line 12-*k***.

The data writing is complete at the moment the scanning line **12-*k* is deselected. However, the driving control signal de remains in a selection state at that moment in the timing diagram shown in FIGS. 2A to 2K, and effective write data (writing current) is thus maintained until the and of the writing. However, since the writing onto the current drivers 15-1 through 15-*m* and the driving of the data lines 13-1 through 13-*m*** are performed serially within one scanning period (typically one frame period/the number of scanning lines) in this driving method, it is sometimes difficult to assure sufficient time for the writing and the driving of the data line.

Second Circuit Example

Figure 6:
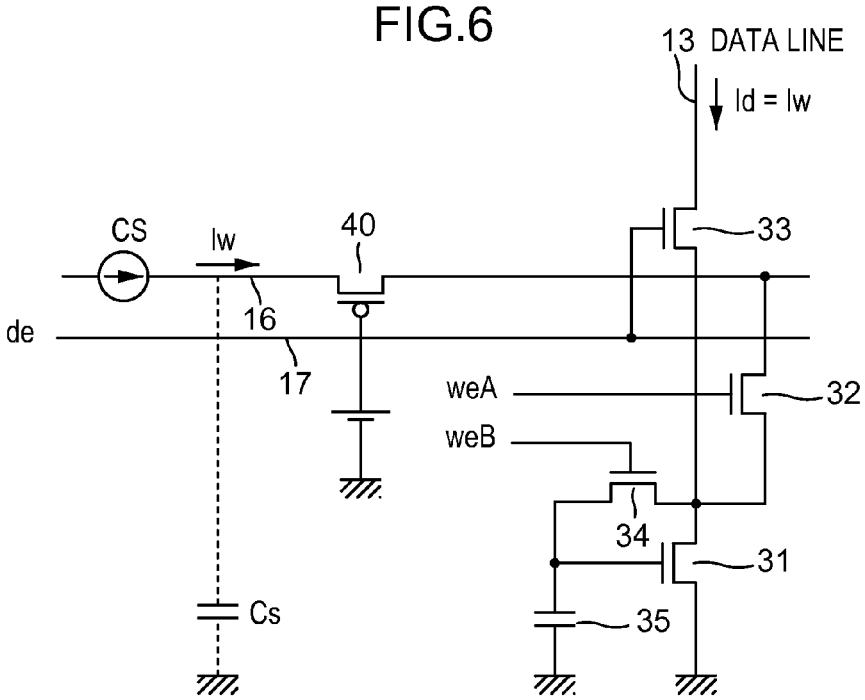
FIG. 6 is a circuit diagram showing a second circuit example of the data line driver.

FIG. 6 is a circuit diagram showing another circuit example of the current drivers 15-1 through **15-*m*. In the figure, the same parts as those of FIG. 4 are indicated by the same symbols as those of FIG. 4**.

The current driver of this example further includes, besides the circuit elements shown in FIG. 4, an impedance transforming Transistor, that is a PMOS-type TFT 40 having a different conductive type from that of the TFT 31, arranged between the TFT 31 and the current source CS, and operating in the saturation region thereof during the writing of the luminance data sin. The impedance transforming TFT 40 is actually connected to the TFT 31 through the TFT 32. With this arrangement, the writing of the luminance data sin onto the current driver is performed faster than the circuit shown in FIG. 4. The reason for this will be discussed.

In the current writing, there is a problem that the time required to the writing is typically longer. When the current Iw is written on the current driver shown in FIG. 4, the output resistance of the current source CS is theoretically infinite, and the resistance of the circuit is determined by the TFT 31 shown in FIG. 4. On the other hand, the driving capability of the TFT in the panel is typically small, in other words, input resistance thereof is high. For this reason, it takes time for the signal input line 16 to reach a steady state.

The time required to complete the writing in the circuit shown in FIG. 4 is now determined. During the writing, the TFT 34 shorts the gate and the drain of the TFT 31, and the TFT 31 operates in the saturation region thereof. By differentiating both sides of the equation (1) of the MOS transistor with the gate-source voltage Vgs, the following equation (7) results.

$$1/Rn=\mu nCoxWn/Ln(Vgsn-Vth) \quad (7)$$

Since the TFT 31 is an NMOS transistor, each symbol is suffixed with the letter n. Rn represents a differentiated resistance viewed from the signal input line 16 of the TFT 31. This is the input resistance of the signal input line 16. The TFT 32 is an analog switch, having resistance characteristics. However, the resistance of the TFT 32 is set to be small, enough compared with that of the TFT 31, and is actually neglected.

The following equation (8) is obtained from the equations (1) and (7).

$$Rn=1/\sqrt{(2\mu nCoxWn/Ln\cdot Iw)} \quad (8)$$

The input resistance Rn of the TFT 31 is inversely proportional to the square root of the writing current Iw, and becomes large value if the writing current Iw is small. Let Cs represent the capacitance Cs associated with the signal input line 16, and the time constant in the writing operation is expressed by the following equation (9) in the vicinity of the steady state.

$$\tau=Cs\times Rn \quad (9)$$

Since the current source CS for supplying the signal input line 16 with a signal current is typically formed of parts external to the panel, the current source CS is typically spaced apart from the data line driving circuit 15. The capacitance Cs tends to be large. The input resistance Rn of the TFT 31 increases with the writing current Iw decreasing. A long writing time required to write a small current becomes a serious problem.

To shorten the writing time, the input resistance Rn of the TFT 31 needs to be reduced from the equation (9). By setting the current corresponding to the maximum luminance value to be larger, the writing current Iw is prevented from becoming too small at a small luminance value. However, this arrangement increases power consumption. The increasing of Wn/Ln of the TFT 31 is contemplated. Since this arrangement causes the TFT 31 to be used with a smaller gate voltage amplitude, the driving current is more easily affected by a low-level noise.

The circuit operation of the circuit shown in FIG. 6 the signal input line 16, and a relatively large parasitic capacitance capacitor Cs is present between the current source CS and the current driver. Now, the Writing operation of writing current 1*w* is now considered. When the impedance transforming TFT 40 operates in the saturation region thereof, the following equation (10) holds in the steady state in accordance with the equation (1).

$$Iw=\mu pCoxWp/Lp/2(Vgs-Vtp)^2 \quad (10)$$

where the symbols here are suffixed with the letter p because the impedance transforming TFT 40 is a PMOS transistor.

Considering that the signal input line 16 is the source of the impedance transforming TFT 40 in the circuit example of FIG. 6, the following equation (11) holds.

$$Iw=\mu pCoxWp/Lp/2(Vin-Vg-|Vtp|)^2 \quad (11)$$

where Vin and Vg respectively represent the voltage of the signal input line 16 and the gate voltage of the impedance transforming TFT 40, each with respect to ground.

If both sides of the equation (11) is differentiated with the voltage Vin of the signal input line 16, the following equation (12) results.

$$1/Rp=\mu pCoxWp/Lp(Vin-Vg-|Vtp|) \quad (12)$$

where Rp is a differentiated resistance viewed from the signal input line 16 of the impedance transforming TFT 40, and is an input resistance of the signal input line 16. The following equation (13) is obtained from the equations (11) and (12).

$$Rp=1/\sqrt{(2\mu pCoxWp/Lp\cdot Iw)} \quad (13).$$

The time constant in the writing operation is expressed by the following equation (14) in the vicinity of steady state.

$$\tau=Cs\times Rp \quad (14).$$

It is noted that the time constant in the writing operation is determined by the P-channel TFT 40 regardless of the parameters (Wn, Ln, etc.) relating to the TFT 31. Specifically, if the Wp/Lp of the impedance transforming TFT 40 is set to be large, the input resistance Rp of the signal input line 16 decreases in accordance with the equation (13), and the time constant in the writing operation decreases in accordance with the equation (14). The writing operation is thus expedited Without modifying the magnitude of the writing current Iw or the parameters of the TFT 31, in other words, without an increase in power consumption and an increase in susceptibility to noise.

With the writing operation expedited, the signal input line 16 is used in a time sharing manner for a predetermined duration of time to write many pieces of data on a row of data line drivers. This arrangement reduces the number of connection points between the panel and the current source CS external to the panel, and the number of the current sources CS.

A method of operating the impedance transforming TFT 40 in the saturation region thereof will now be discussed. The condition under which the MOS transistor Operates in the saturation region thereof is determined by the equation (3). The condition of the PMOS transistor may be rewritten as follows:

$$Vd<Vg+|Vtp| \quad (15)$$

where Vd and Vg respectively represent the drain voltage and the gate voltage of the PMOS transistor referenced to ground.

The writing time becomes a concern when the writing current Iw is small. Now, a writing current Iw close to zero is considered. The TFT 34 electrically shorts the gate and the drain of the TFT 31, and a current flowing therethrough is nearly zero. For this reason, the drain Voltage is approximately Vtn, and also equals the drain voltage Vd of the impedance transforming TFT 40. The equation (15) may be rewritten as the following equation (16).

$$Vtn<Vg+|Vtp| \quad (16)$$

To allow the TFT 40 to operate in the saturation region thereof, the equation (16) must hold. Specifically, the relationship of Vtn<|Vtp| must hold if the gate voltage Vg=0, or the gate voltage Vg must be higher than zero.

As described above, by connecting the impedance transforming transistor (the P-channel TFT 40 here) operating in the saturation region thereof when the luminance data sin is written, between the TFT 31 and the current source CS, it is possible to write the luminance data sin on the current driver faster than the circuit shown in FIG. 4. This arrangement enables the signal input line 16 to write many pieces of data on the row of data line drivers in a time sharing manner within a constant duration of time. The number of connection points between the panel and the current source CS external to the panel and the number of the current sources CS are reduced.

Figure 7:
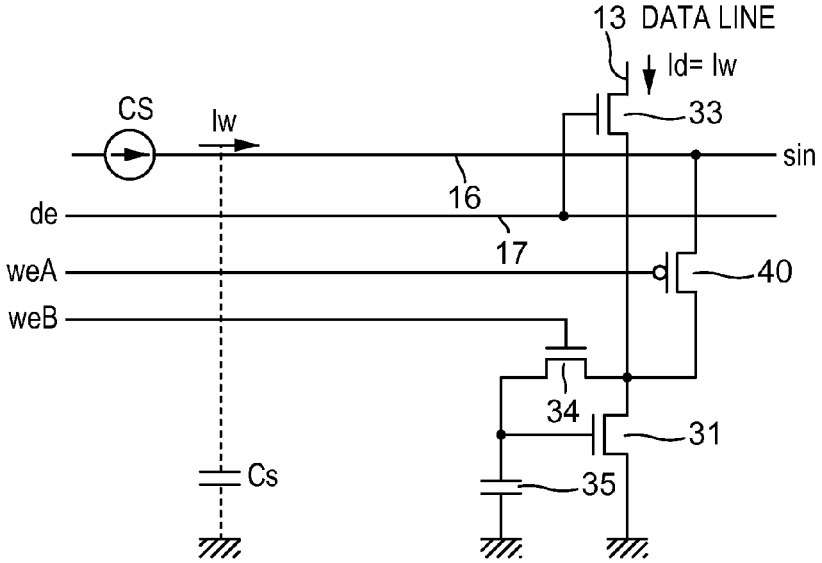
FIG. 7 is a circuit diagram showing a modification of the second circuit example of the data line driver.

In this circuit example, the P-channel TFT 40 together with the TFT 32 is arranged between the TFT 31 and the current source CS. Alternatively as shown in FIG. 7, the P-channel TFT 40 operating in the saturation region thereof during the writing of the luminance data sin may replace the TFT 32 in order to allow the P-channel TFT 40 itself to perform both functions of impedance transformation and switching (performed by the TFT 32 in FIG. 6). This modification presents the same advantages as those of the circuit. In the case of the modification example, since the number of transistors is reduced with one per current driver, the circuit arrangement becomes simplified and less costly.

Second Embodiment

Figure 8:
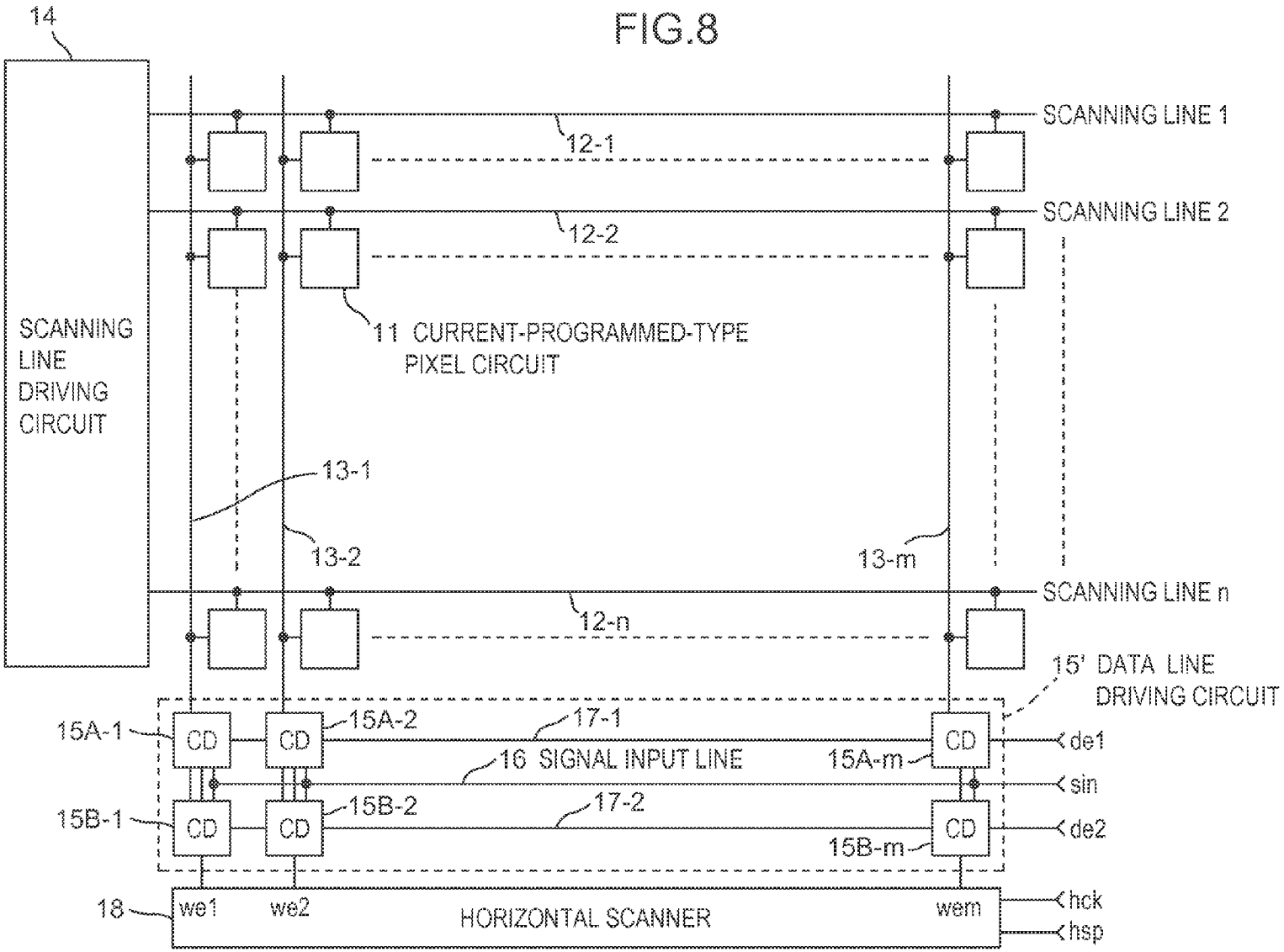
FIG. 8 is a block diagram showing an example of the configuration of an active-matrix display device according to a second embodiment of the present invention.
Figures 9A, 9B, 9C, 9D, 9E, 9F, 9G, 9H, 9I, 9J:
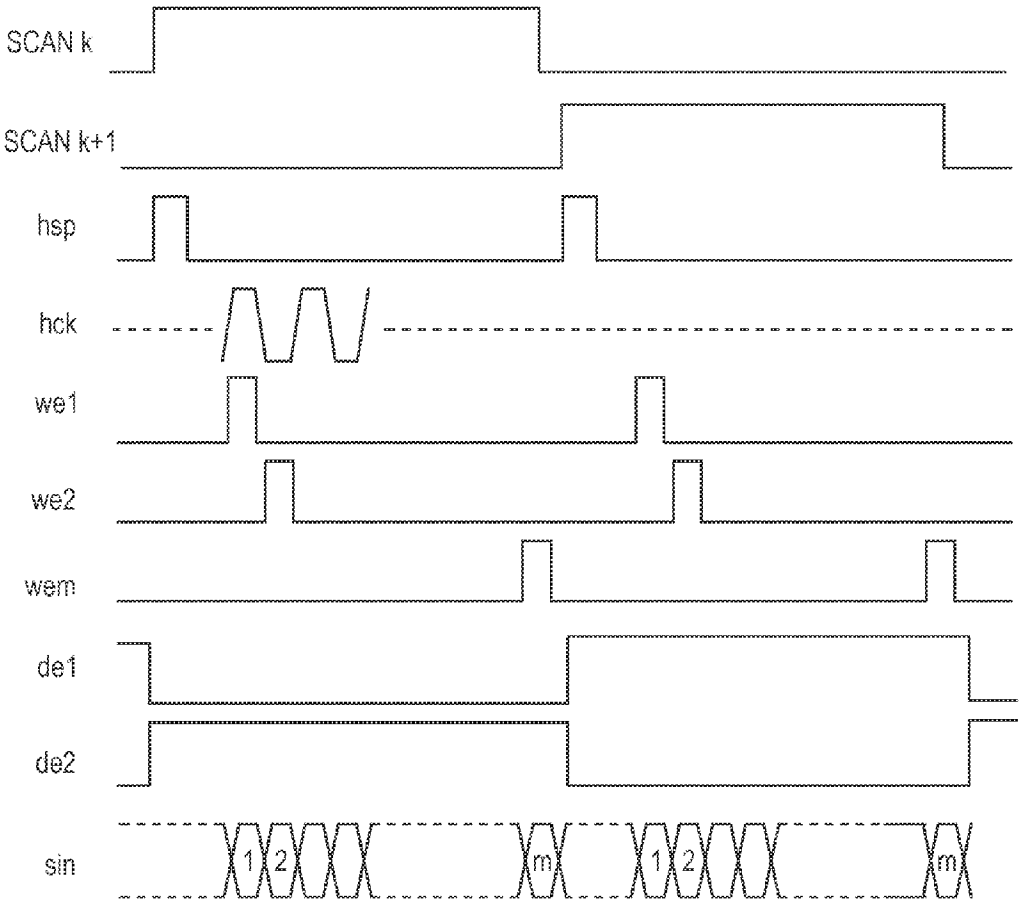
FIGS. 9A to 9J are timing diagrams for explaining the circuit operation of the active-matrix display device according to the second embodiment.

FIG. 8 is a block diagram of an example of the configuration of an active-matrix display device according to a second embodiment of the present invention. In the figure, the same parts as those of FIG. 1 is indicated by the same symbols as those of FIG. 1. The active-matrix display device of the second embodiment is different from that of the first embodiment in the construction of a data line driving circuit 15'.

In the first embodiment, the data line driving circuit 15 is composed of a single row of current drivers 15-1 through **15-*m*, while the data line driving circuit 15' of the second embodiment includes two rows of current drivers 15A-1 through 15A-m and 15B-1 through 15B-m. The two rows of current drivers 15A-1 through 15A-m and 15B-1 through 15B-m are supplied with the image data (the luminance data here) sin through the signal input line 16**.

The two rows of current drivers 15A-1 through 15A-m and 15B-1 through 15B-m are respectively supplied with two driving control signals de1 and de2 through two control lines 17-1 and 17-2. With reference to the timing diagram shown in FIGS. 9A to 9J, the two driving control signals de1 and de2 are inverted in polarity and are mutually opposite in phase every scanning period.

Referring to FIGS. 9A to 9J, subsequent to the input of the horizontal start pulse hsp, the horizontal scanner 18 successively generates a series of writing control signals we1-wem in response to the level transition of the horizontal clock hck (the rising edge and the falling edge of the horizontal clock hck). This series of writing control signals we1-wem are fed to the two rows of current drivers 15A-1 through 15A-m and 15B-1 through 15B-m.

Third Circuit Example

Figure 10:
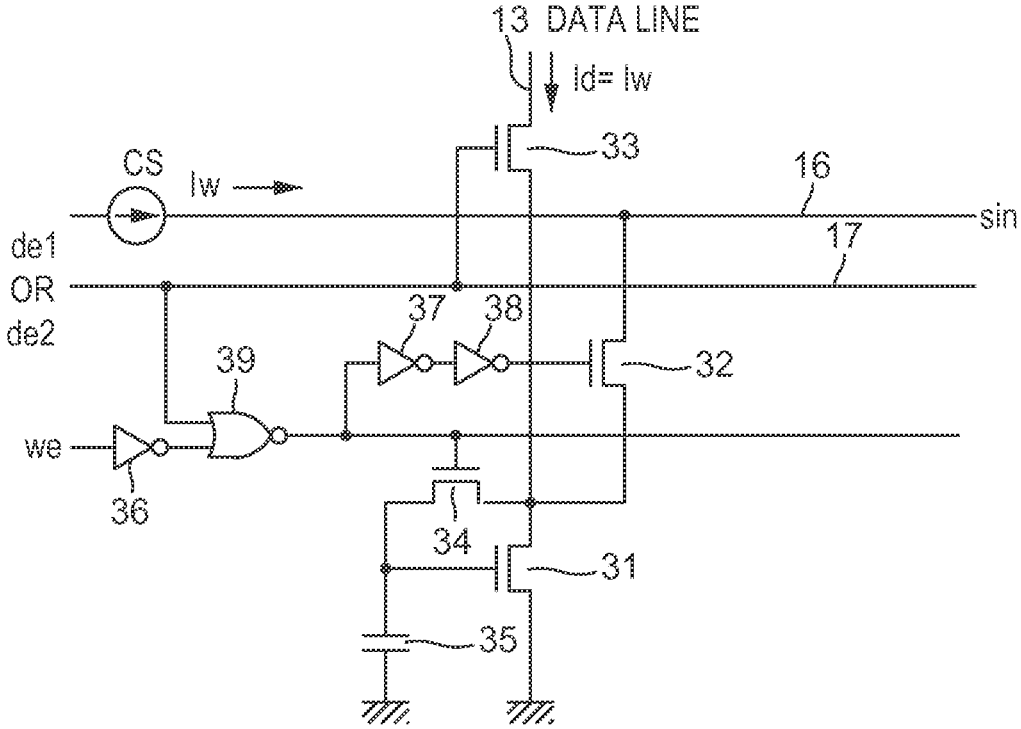
FIG. 10 is a circuit diagram showing a third circuit example of the data line driver.

FIG. 10 is a circuit diagram showing a concrete circuit example of the current drivers 15A-1 through 15A-m and 15B-1 through 15B-m. In the figure, the same parts of those of FIG. 4 are indicated by the same symbols as those of FIG. 4. The current driver according to the present example is identical to the current driver shown in FIG. 4 in that it includes the four TFTs 31-34 and the single capacitor 35.

The current driver shown in FIG. 10 is different from that shown in FIG. 4 in a circuit controlling the TFT 32 and the TFT 34. The control circuit includes three inverters 36, 37, and 38 and an NOR circuit 39. The inverter 36 inverts the polarity of the writing control signal we supplied from the horizontal scanner 18, and then feeds the writing control signal we to one input of the NOR circuit 39. The NOR circuit 39 receives, at the other input, a driving control signal de1 (or de2) supplied through a control line 17-1 (or 17-2) from outside.

The driving control signal de1 (or de2), transferred through the NOR circuit 39, is directly fed to the gate of the TFT 34 while being input to the gate of the TFT 32 through the inverters 37 and 38. The inverters 37 and 38 present a delay time equal to the delay time by which the first writing control signal weA is delayed from the second writing control signal weB shown in FIGS. 2A to 2K. The driving control signal de1 (or de2), transferred through the NOR circuit 39, is input to the gate of the TFT 32 after being delayed by that delay time.

In the current driver having the above-mentioned configuration, the circuit operation of the current driver is basically identical to that of the current driver shown in FIG. 4. Specifically, the luminance data sin in the form of current is converted into a voltage, which is then held in the capacitor 35. After the writing of the data, the data line 13 is driven by a current substantially equal to the written current based on the voltage held in the capacitor 35.

In the current driver according to the present example, it is possible to write the luminance data sin by setting the driving control signal de1 (or de2) to a deselection state (at a low level) and the writing control signal we to a selection state (at a high level). By setting the driving control signal de1 (or de2) to a selection state, the data line 13 is driven, regardless of the state of the writing control signal we.

The inverters 37 and 38 form a delay circuit, as already described. Because of the delay function of the inverters 37 and 38, the TFT 34 is turned of before the TFT 32 when the writing to the current driver ends. The data writing is thus reliably performed.

The active-matrix display device of the second embodiment shown in FIG. 8 thus includes the current-programmed-type pixel circuit shown in FIG. 35 as the pixel circuit 11 and the current-programmed-type current driver shown in FIG. 10. The operation of the active-matrix display device thus constructed will now be discussed with reference to a timing diagram shown in FIGS. 9A to 9J.

During a selection period of a k-th scanning line 12-*k*, the driving control signal de1 is set to a deselection state, and the device becomes capable of writing the luminance data sin onto the first row of data line drivers (the current drivers 15A-1 through 15A-m) from the signal input line 16. Meanwhile, the writing control signals we1-wem are successively output from the horizontal scanner 18 in response to the horizontal clock hck, and in synchronization with the writing control signals we1-wem, the luminance data sin in the form of current is given to the signal input line 16, and the luminance data is then written onto the first row of data line drivers.

When a (k+1)-th scanning line 12-(*k*+1) is selected, the driving control signal de1 is set to a selection state, and the data lines 13-1 through 13-*m* are driven by data written on the current drivers 15A-1 through 15A-m. At this time, the driving control signal de2 is then set to a deselection state, and the luminance data sin is written onto the second row of the current driver (the current drivers 15B-1 through 15B-m). The second row of the current drivers 15B-1 through 158-*m* drive the data lines 13-1 through 13-*m* when a (k+2)-th scanning line 12-(*k*+2) is selected in the next scanning cycle.

In this way, by alternating the first and second rows of the data line drivers (the current drivers 15A-1 through 15A-m and 15B-1 through 15B-m) between a written state and a driving state each time the scanning lines 12-1 through 12-*n* are successively selected, the writing time to the data line driving circuit 15' and the driving time for the data lines 13-1 through 13-*m* are generally kept to within one scanning period. Accordingly, the writing to the data line driving circuit 15' and the driving of the data lines 13-1 through 13-*m* are reliably performed.

Note that, in the present embodiment, the current drivers 15A-1 through 15A-m and 15B-1 through 15B-m were explained based on an example of using the current-programmed-type current driver shown in FIG. 10, however, the present invention in not limited to this. The present invention can be applied to the current-programmed-type current drivers shown in FIG. 4, FIG. 6, and FIG. 7, it is possible to obtain the same operations and the same advantages. The circuit shown in FIG. 10, using a single signal line for inputting the writing control signal we1-wem, works with a reduced number of wires between the data line driving circuit 15 and the horizontal scanner 18, in comparison with the circuits shown in FIG. 4, FIG. 6, and FIG. 7 which needs two signal lines.

When it is difficult to complete the writing on the current drivers 15A-1 through 15A-m and 15B-1 through 15B-m within one scanning period in the active-matrix display device according to the present embodiment, a plurality of signal input lines 16 may be employed to perform parallel writing (a modification of the second embodiment).

Figure 11:
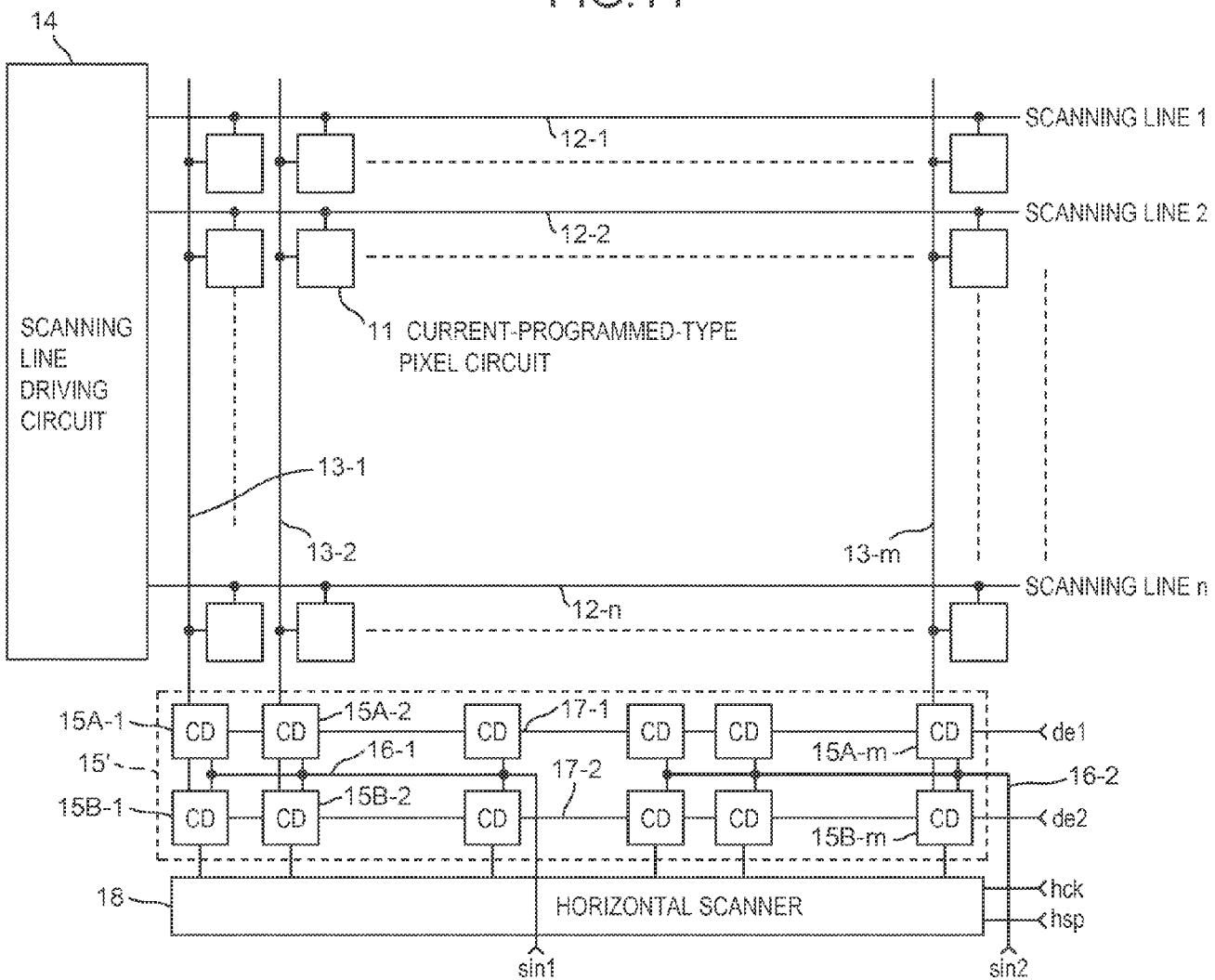
FIG. 11 is a block diagram showing an example of the configuration of an active-matrix display device according to a modification of the second embodiment.

Specifically as shown in FIG. 11, two signal input lines 16-1 and 16-2 are arranged, and the current drivers 15A-1 through 15A-m and 15B-1 through 15B-m are divided into two blocks as a left half and a right half. The signal input line 16-1 writes data onto the left half of the current drivers 15A-1 through 15A-m and 15B-1 through 15B-m and the signal input line 16-2 writes data onto the right half of the current drivers 15A-1 through 15A-m and 15B-1 through 15B-m.

In this arrangement, since the luminance data sin can be written onto the current drivers 15A-1 through 15A-m and 15B-1 through 15B-m on a two at a time basis (in parallel), and the writing time per data line driver is doubled, the writing operation is thus facilitated. It is also possible to arrange three or more signal input line 16.

It is also possible to implement the fast luminance data writing concept discussed with reference to FIG. 6 in the active-matrix display device in which the current drivers 15A-1 through 15A-m and 15B-1 through 15B-m are divided into the left-half block and the right-half block. In this case, the circuit shown in FIG. 4 is used as the current-programmed-type current driver.

Figure 12:
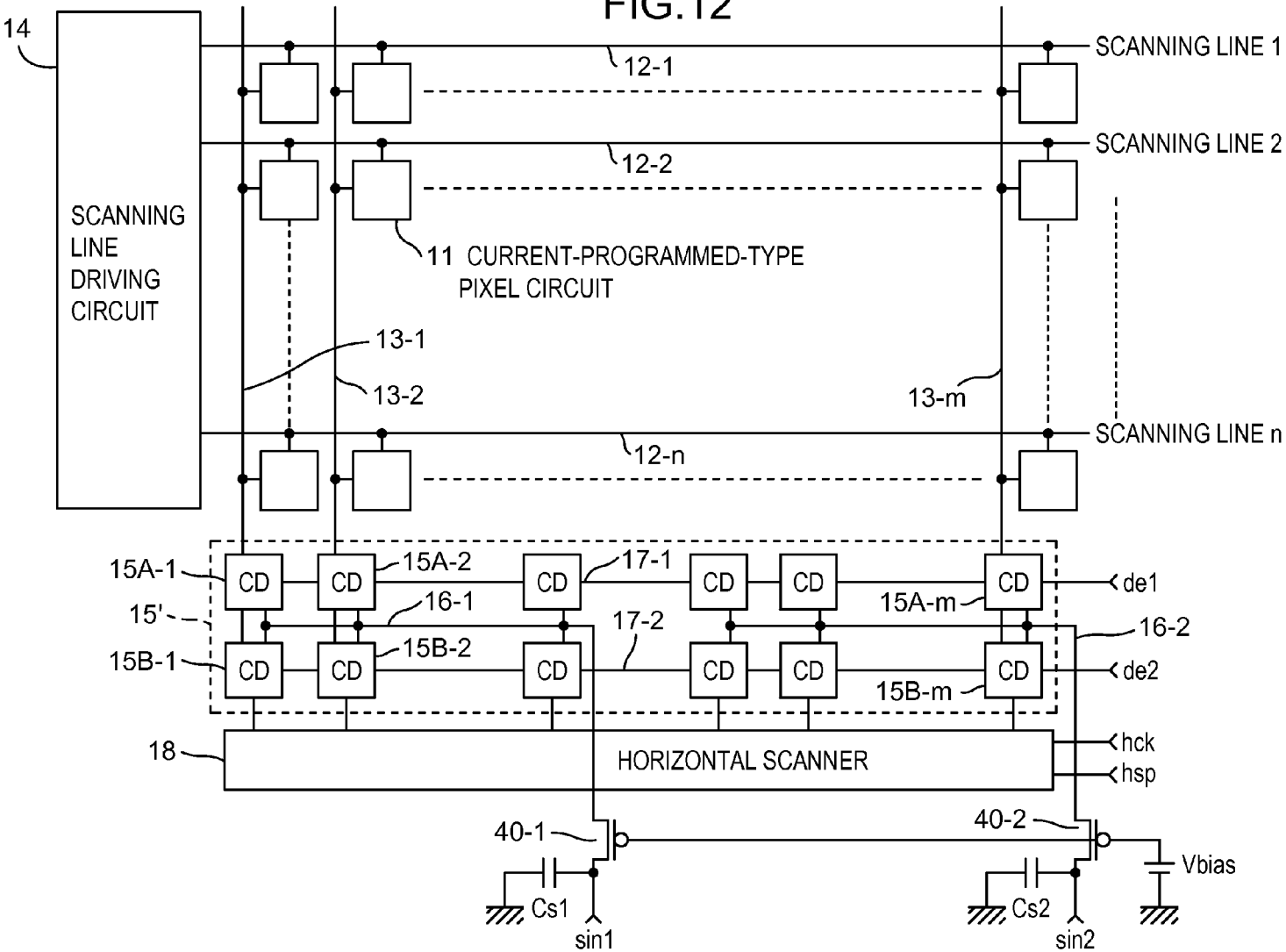
FIG. 12 is a block diagram showing an example of the configuration of an active-matrix display device according to another modification of the second embodiment.

Referring to FIG. 12, impedance transforming transistors such as P-channel TFTs 40-1 and 40-2 are respectively connected to inputs of the signal input lines 16-1 and 16-2. The TFTs 40-1 and 40-2 are biased with bias voltage Vbias higher than ground potential. Parasitic capacitances Cs1 and Cs2 Are respectively associated with the signal input lines 16-1 and 16-2. By setting the bias voltage Vbias to an appropriate value, the P-channel TFTs 40-1 and 40-2 are operated in the saturation region thereof.

In this way, the current drivers 15A-1 through 15A-m and 15B-1 through 15B-m are divided into two blocks, and the impedance transforming transistors, that is, the P-channel TFTs 40-1 and 40-2, operating in the saturation region thereof during the writing of the luminance data are arranged commonly on plurality of current drivers in the respective blocks. By setting the value of Wp/Lp of the TFTs 40-1 and 40-2 to be large, the writing of the luminance data is expedited without modifying the circuit arrangement and constants of the current drivers 15A-1 through 15A-m and 15B-1 through 15B-m by the same reason as that of the explanation of the circuit in FIG. 6.

Figure 13:
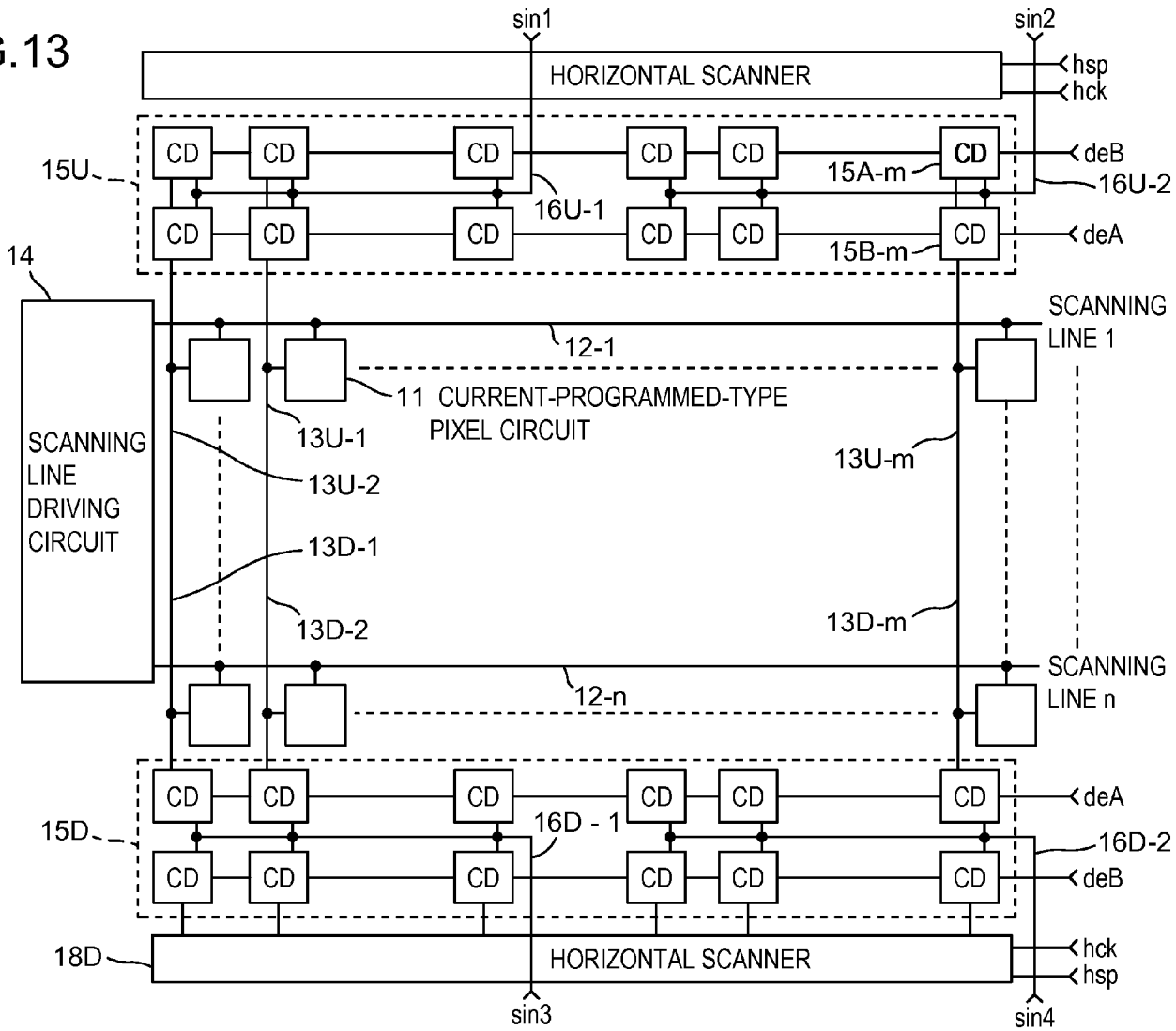
FIG. 13 is a block diagram showing an example of the configuration of an active-matrix display device according to yet another modification of the second embodiment.

A circuit arrangement shown in FIG. 13 may be implemented as another modification of the second embodiment. Further to the arranged shown in FIG. 11, the active-matrix display device shown in FIG. 13 divides the data lines 13-1 through 13-*m* at the center thereof into two, and data line driving circuits 15U and 15D are arranged above and below the display area.

In this case, horizontal scanners 18U and 18D are also arranged above and below the display area. Since the circuit arrangement shown in FIG. 11 is also partly employed, the upper data line driving circuit 15U is provided with two signal input line 16U-1 and 16U-2 and the lower data line driving circuit 15D is provided with two signal input lines 16D-1 and 16D-2.

In this arrangement, data lines 130-1 through 13U-m and data lines 13D-1 through 13D-m respectively driven by the data line driving circuits 15U and 15D have wiring length as half as that in the circuit arrangement shown in FIG. 11. Capacitances of the data lines 130-1 through 130-*m* and the data lines 13D-1 through 13D-m are thus half those of the circuit arrangement shown in FIG. 11. The driving time of the data line is accordingly short.

Since the selection and the writing are concurrently performed on two of the scanning lines 12-1 through 12-*n*, one in the top half and the other in the bottom half of the display screen, the writing time per scanning line is doubled. For this reason, the driving of the data lines 13U-1 through 13U-m and the data lines 13D-1 through 13D-m and the data writing to the data line driving circuits 15U and 15D can be reliably performed.

Fourth Circuit Example

Figure 14:
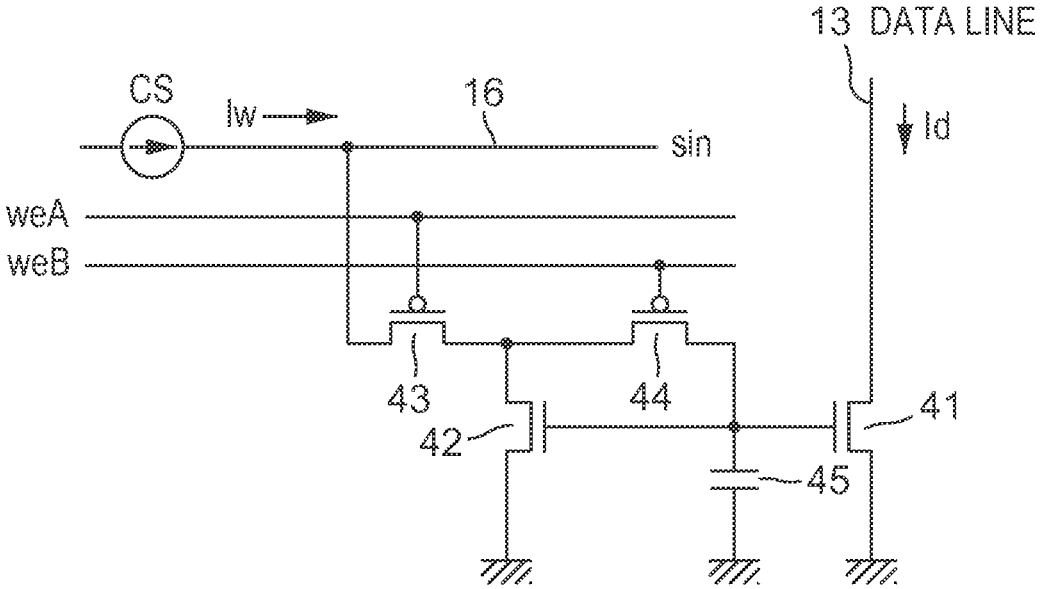
FIG. 14 is a circuit diagram showing a fourth circuit example of the data line driver.

FIG. 14 is a circuit diagram of another circuit example of the current driver. The current driver here may be employed as each of the current drivers 15-1 through 15-M in the data line driving circuit 15 of the first embodiment see FIG. 1) or as each of the current drivers 15A-1 through 15A-m and 15B-1 through 15B-m in the data line driving circuit 15' in the second embodiment.

As seen from FIG. 14, the current driver according to the present example includes four TFTs 41-44 and a capacitor 45. In this current driver, the TFTs 41 and 42 are NMOS transistors and the TFTs 43 and 44 are PMOS transistors. The present invention is not limited to this arrangement.

The TFT 41 is configured with the source thereof grounded and with the drain thereof connected to a data line 13. A capacitor C is connected between the gate of the TFT 41 and ground. The gate of the TFT 41 is respectively connected to the gate of the TFT 42 and the drain of the TFT 44. The TFT 41 and the TFT 42 are arranged in a close vicinity with the gates thereof connected to each other, thereby forming a current mirror.

The source of the TFT 42 is grounded. The drain of the TFT 42, the drain of the TFT 43, and the source of the TFT 44 are connected together. The TFT 43 is configured with the source thereof connected to a signal input line 16, and with the gate thereof receiving a first writing control signal weA. The TFT 44 receives a second writing control signal weB at the gate thereof.

Figures 15A, 15B, 15C:
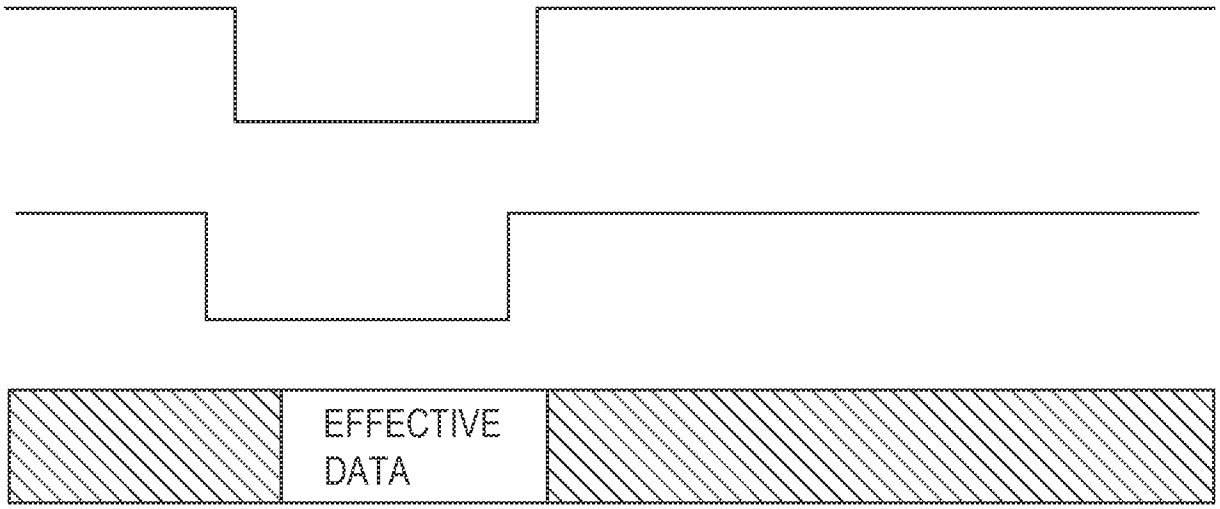
FIGS. 15A to 15C are timing diagrams illustrating the circuit operation of the fourth circuit example of the data line driver.

The circuit operation of the current driver thus constructed will now be discussed, referring to a driving waveform diagram shown in FIGS. 15A to 15C.

To write the data onto the current driver, both the first writing control signal weA and the second writing control signal weB are set to a selection state. Here, the selection state is that both signals are at a low level. At this state, by connecting the current source CS providing a writing current Iw to the signal input line 16, the writing current Iw flows through the TFT 42 from the TFT 43. At this time, since the gate and the drain of the TFT 42 are electrically shorted by the TFT 44, the equation (3) holds and the TFT 42 operates in the saturation region thereof. The voltage Vgs expressed by the equation (1) is generated between the gate and the source of the TFT 42.

Next, the first and second writing control signals JO weA and weB are set to a deselection state. More specifically, the second writing control signal weB is driven high, thereby turning off the TFT 44. The voltage Vg generated between the gate and the source of the TFT 42 is held in the capacitor 45.

Next, the first writing control signal weA is driven high, turning off the TFT 43. Since the current driver is electrically isolated from the current source CS, the current source CS thereafter is able to perform writing on another current driver. The data from the current source CS has to be effective at the moment the second writing control signal weB is in a deselection state. Thereafter, the data from the current source CS can be at any level (for example, write data to the next current driver).

The current mirror is formed of the TFT 41 and the TFT 42 with the gates thereof mutually connected. If the TFT 41 operates in the saturation region thereof, the current flowing through the TFT 41 is expressed by the equation (2). This becomes a current flowing through the data line 13, and is proportional to the writing current Iw.

Like the circuit shown in FIG. 4, the circuit shown in FIG. 14 converts the luminance data sin in the form of current into a voltage, and holds the voltage in the capacitor 45, and drives the data line 13 with a current substantially proportional to the written current based on the voltage held in the capacitor 45 even after writing. In this operation, the TFT 41 and the TFT 42 are substantially identical in carrier mobility and threshold value Vth because the two transistors are arranged in a close vicinity, and the absolute values of these are not important. In other words, the circuit shown in FIG. 14 drives the data line 13 with the current accurately equal to the written current regardless of variations in the TFT characteristics.

The relationship between the writing Current Iw to the current driver and the driving current Id to the data line 13 is set to a desired value by properly setting the channel width W to the channel length L of each of the two transistors, in other words, by setting a mirror ratio of the current mirror.

If the ratios of W/L of the TFT 41 and the TFT 42 are set to be equal to each other, the writing current Iw equals the driving current Id. If the W/L ratio of the TFT 42 is set to be larger than that of the TFT 41, the writing current Iw becomes larger than the driving current Id. The latter setting is effective when an external current source CS has difficulty in driving the current driver because of its small current output, or when the writing of the current driver needs to be expedited.

Figure 16:
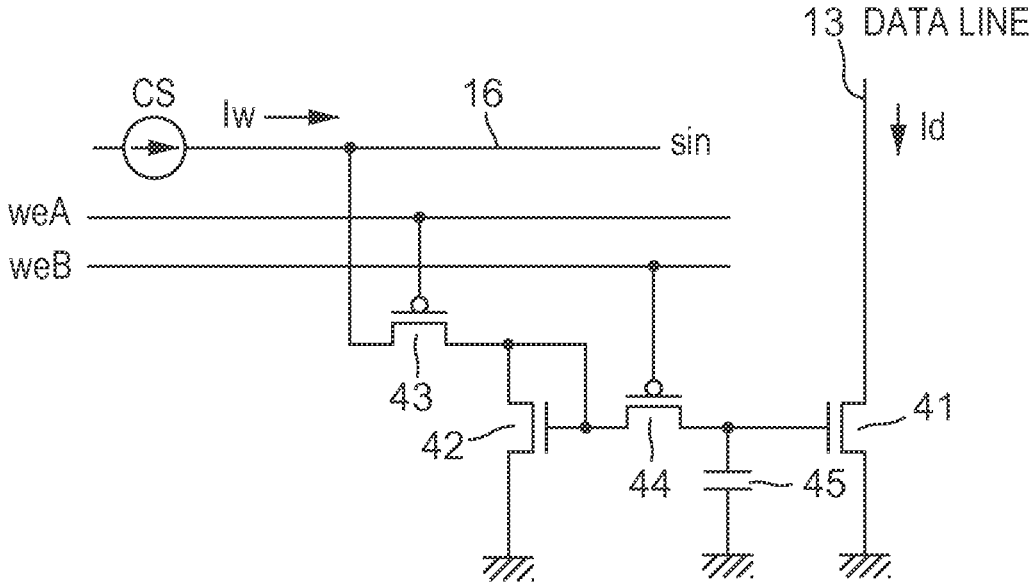
FIG. 16 is a circuit diagram showing a modification of the fourth circuit example of the data line driver.

FIG. 16 shows a modification of the current driver. The current driver shown according to the modification example is different from the circuit shown in FIG. 14 only in the connection of the TFT 44. Specifically, the TFT 44 is connected between the gate of the TFT 41 and the gate of the TFT 42. The circuit operation of the modification remains unchanged from that of the circuit shown in FIG. 14.

Fifth Circuit Example

Figure 17:
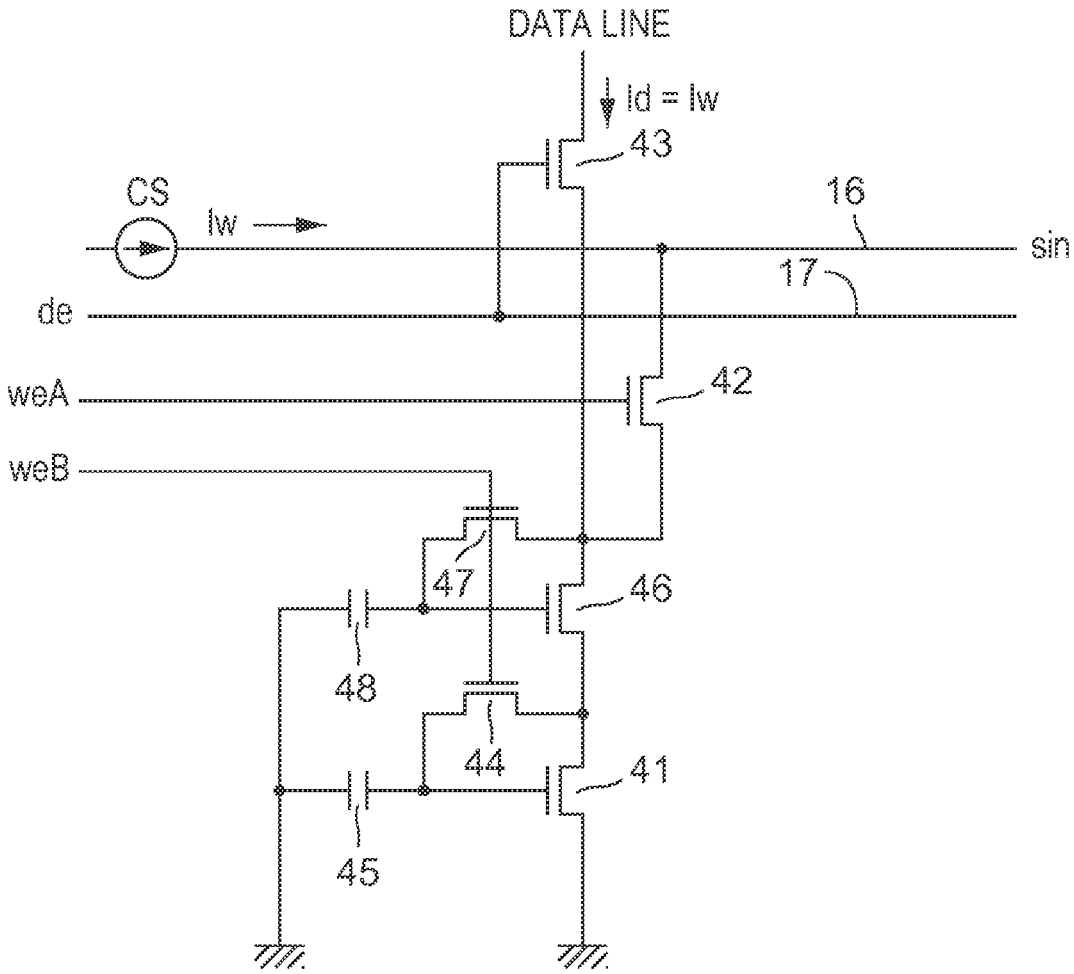
FIG. 17 is a circuit diagram of a fifth circuit example of the data line driver.

FIG. 17 is a circuit diagram showing yet another circuit example of the current driver. The current driver here may be employed as each of the current drivers 15-1 through **15-*m* in the data line driving circuit 15 of the first embodiment (see FIG. 1) or as each of the current drivers 15A-1 through 15A-m and 15B-1 through 15B-m in the data line driving circuit 15'** in the second embodiment.

The current driver according to the present example is basically identical to the first circuit example of the current driver (see FIG. 4) in circuit arrangement, and the discussion that follows focuses on the difference therebetween. In FIG. 17, the same parts as those of FIG. 4 are indicated by the same symbols as those of FIG. 4.

Referring to FIG. 17, a TFT 46 is inserted between the drain of the TFT 41 and the data line 13. A TFT 47 is connected between the gate and the drain of the TFT 46. The TFT 47 receives a second writing control signal weB at the gate thereof. A capacitor 48 is connected between the gate of the TFT 46 and ground.

The circuit operation of the current driver thus constructed will now be discussed. Since the circuit operation of the fifth circuit example remains unchanged from that of the circuit shown in FIG. 4, the waveform diagram shown in FIGS. 5A to 5D are referred to.

To perform writing onto the current driver, the driving control signal de is set to a deselection state (at a low level) to prevent a current from flowing into the data line 13. The first writing control signal weA and the second writing control signal weB are then set to a selection state (at a high level). The writing current Iw flows through the TFT 41 and the TFT 46 from the TFT 42. At this time, since the gate and the source of the TFT 41 and the gate and the source of the TFT 46 are respectively shorted by the TFT 44 and the TFT 47, the two transistors thus operate in the saturation regions thereof.

Next, the second writing control signal weB is set to a deselection state. In response, the voltage Vgs generated between the gate and the source of the TFT 41 is held in the capacitor 45, and the voltage Vgs generated between the gate and the source of the TFT 46 is held in the capacitor 48. The first writing control signal weA is then set to a deselection state, thereby electrically isolating the current driver from the signal input line 16. Thereafter, the writing operation is performed on another current driver through the signal input line 16.

The data line driving control signal de is driven high. Since the gate-source voltage Vgs of the TFT 41 is held in the capacitor 45, the current flowing through the TFT 41 coincides with the writing current 1*w* expressed by the equation (5) if the TFT 41 operates in the saturation region thereof. This becomes the current Id flowing through the data line 13. In other words, the writing current Iw agrees with the driving current Id of the data line 13.

The operation of the TFT 46 will now be discussed. In the circuit shown in FIG. 4, as mentioned above, the writing current Iw and the driving current Id of the data line 13 are determined by the TFT 41, and from the equations (5) and (6), the relationship of Iw=Idrv holds. But this is based on the assumption that the current Ids flowing through the TFT 41 is not dependent on the drain-source voltage Vds in the saturation region.

In an actual transistor, there are times when the drain-source current Ids is large as the drain-source voltage Vds becomes large even if the gate-source voltage Vgs remains constant. This is due to the short-channel effect in which an effective channel length is shortened when a pinch-off point in the vicinity of the drain region shifts toward the source side as the drain-source voltage Vds becomes larger, or due to the back gate effect in which the conductivity of the channel changes when the voltage of the drain affects the voltage of the channel.

In this case, the drain-source current Ids flowing through a transistor depends on the drain-source voltage Vds as expressed by the following equation (17).

$$Ids=\mu CoxW/L/2(Vgs-Vth)^2\times(1+\lambda Vds) \quad (17)$$

where λ is a positive constant. In the circuit shown in FIG. 4, the writing current Iw does not coincide with the Idrv flowing through the OLED if the drain-source voltage Vds is not equal during the writing and during driving operations.

Contrary to this, the circuit shown in FIG. 17 is now considered. To note in the operation of the TFT 46 of FIG. 17, the voltage of the drain thereof during writing and that during driving are not equal. For example, when the drain potential during driving is higher, the drain-source voltage Vds of the TFT 46 also becomes higher. From the equation (17), the drain-source current Ids increases during driving even if the gate-source voltage Vgs remains constant regardless of the writing and driving operations. In other words, the current Idrv flowing through the OLED is not equal to but becomes larger than the writing current Iw.

Since the current Idrv flowing through the OLED also flows through the TFT 41, the voltage drop through the TFT 41 increases, thereby raising the drain potential thereof (i.e., the source potential of the TFT 46). As a result, the gate-source voltage Vgs of the TFT 46 becomes lower, working in the direction to reduce the current Idrv flowing through the OLED. The drain potential of the TFT 46 is unable to greatly vary. To note the TFT 41, the drain-source current Ids of the TFT 41 does not greatly vary between the writing operation and the driving operation. Consequently, the writing current Iw and the current Idrv flowing through the ° LED coincide with each other with a relatively high accuracy.

To allow the circuit to perform better the above-referenced operation, the drain-source current Ids needs to be less dependent on the drain-source voltage Vds in each of the TFT 41 and the TFT 46. To this end, the two transistors preferably operate in the saturation regions thereof. Since each of the TFT 41 and the TFT 46 is shorted between the gate and drain thereof during the writing operation, the two transistors are forced to operate in the saturation region thereof regardless of written luminance data. To allows the two transistors to operate in the saturation region thereof even during driving, the data line 13 needs to be at a sufficiently high potential. In this way, the current Id flowing through the data line 13 accurately coincides with the writing current Iw regardless of variations in the TFT characteristics.

Third Embodiment

Figure 18:
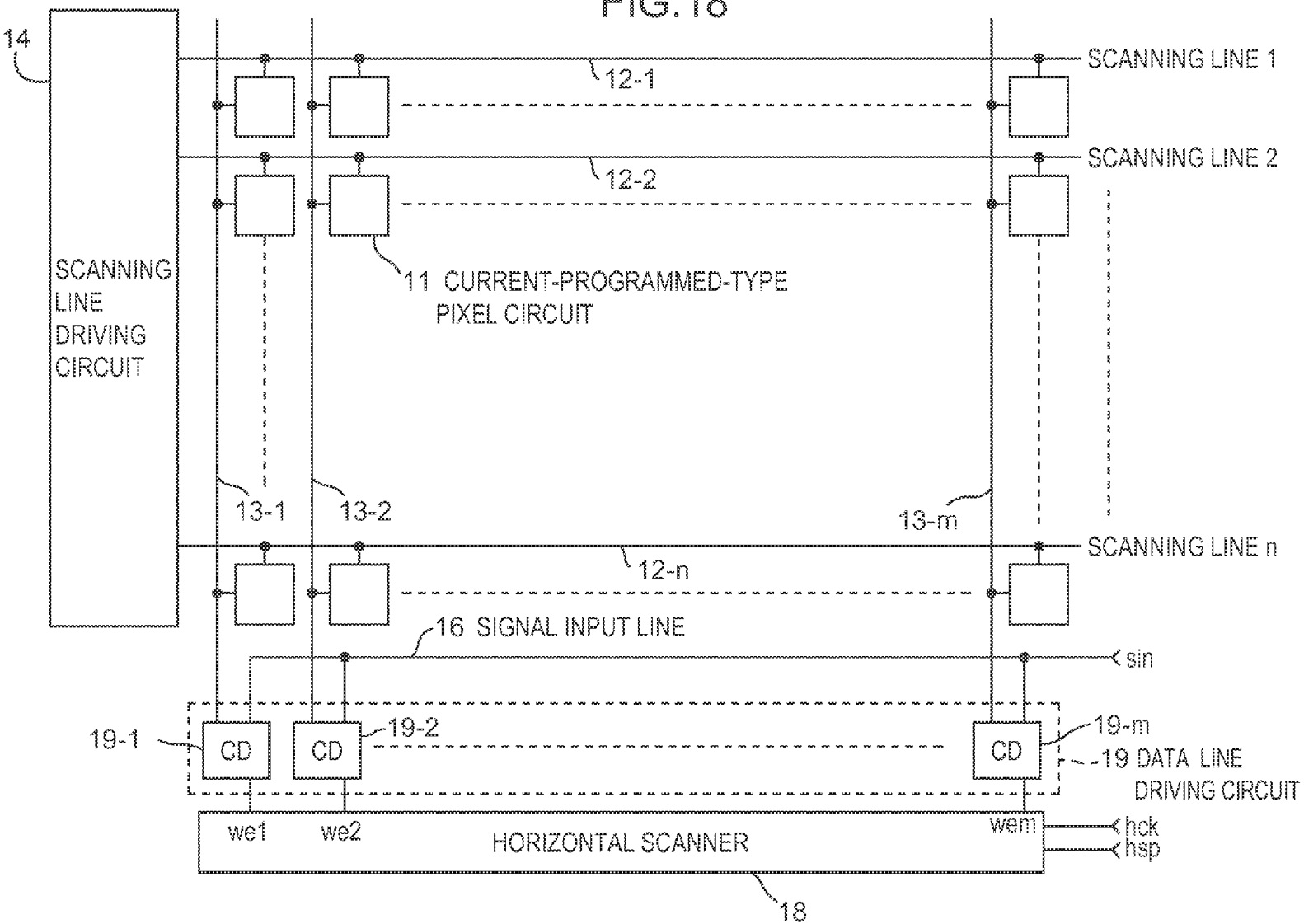
FIG. 18 is a block diagram showing an example of the configuration of an active-matrix display device according to a third embodiment of the present invention.

FIG. 18 is a block diagram showing an example of the configuration of an active-matrix display device according to a third embodiment of the present invention. In the figure, the same parts as those of FIG. 1 are indicated by the same symbols as those of FIG. 1. The active-matrix display device according to the present embodiment is different from that of the first embodiment in the construction of the data line driving circuit for driving the data lines.

More specifically, the first embodiment employs a current-programmed-type current driver for the data line driving circuit 15, while the present embodiment employs voltage-programmed-type current drivers (CD) 19-1 through **19-*m* as a data line driving circuit 19. The output terminals of the voltage-programmed type current drivers (hereinafter simply referred to as current drivers) 19-1 through 19-*m* are respectively connected to ends of the data lines 13-1 through 13-*m***.

Sixth Circuit Example

Figure 19:
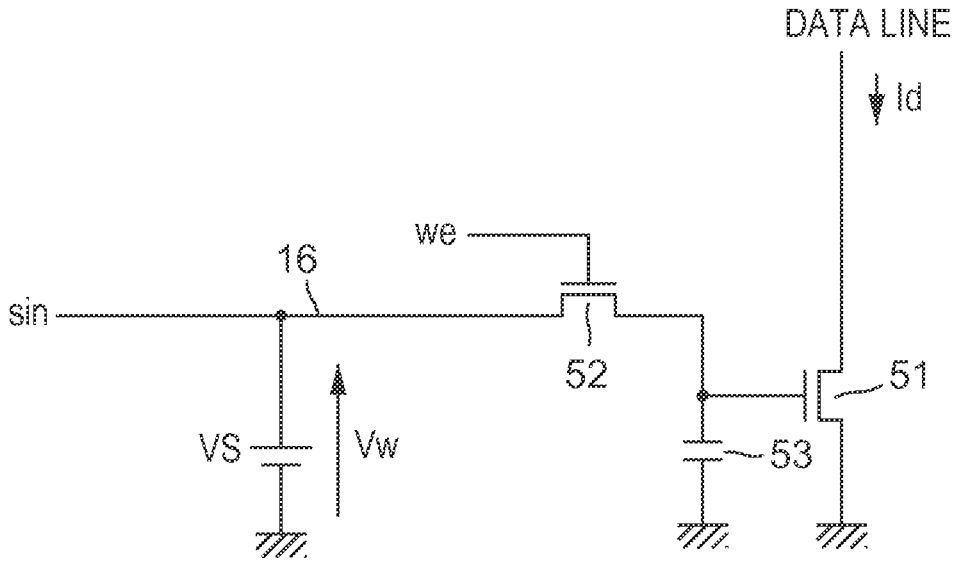
FIG. 19 is a circuit diagram showing a sixth circuit example of the data line driver.
Figures 20A, 20B, 20C, 20D, 20E, 20F, 20G:
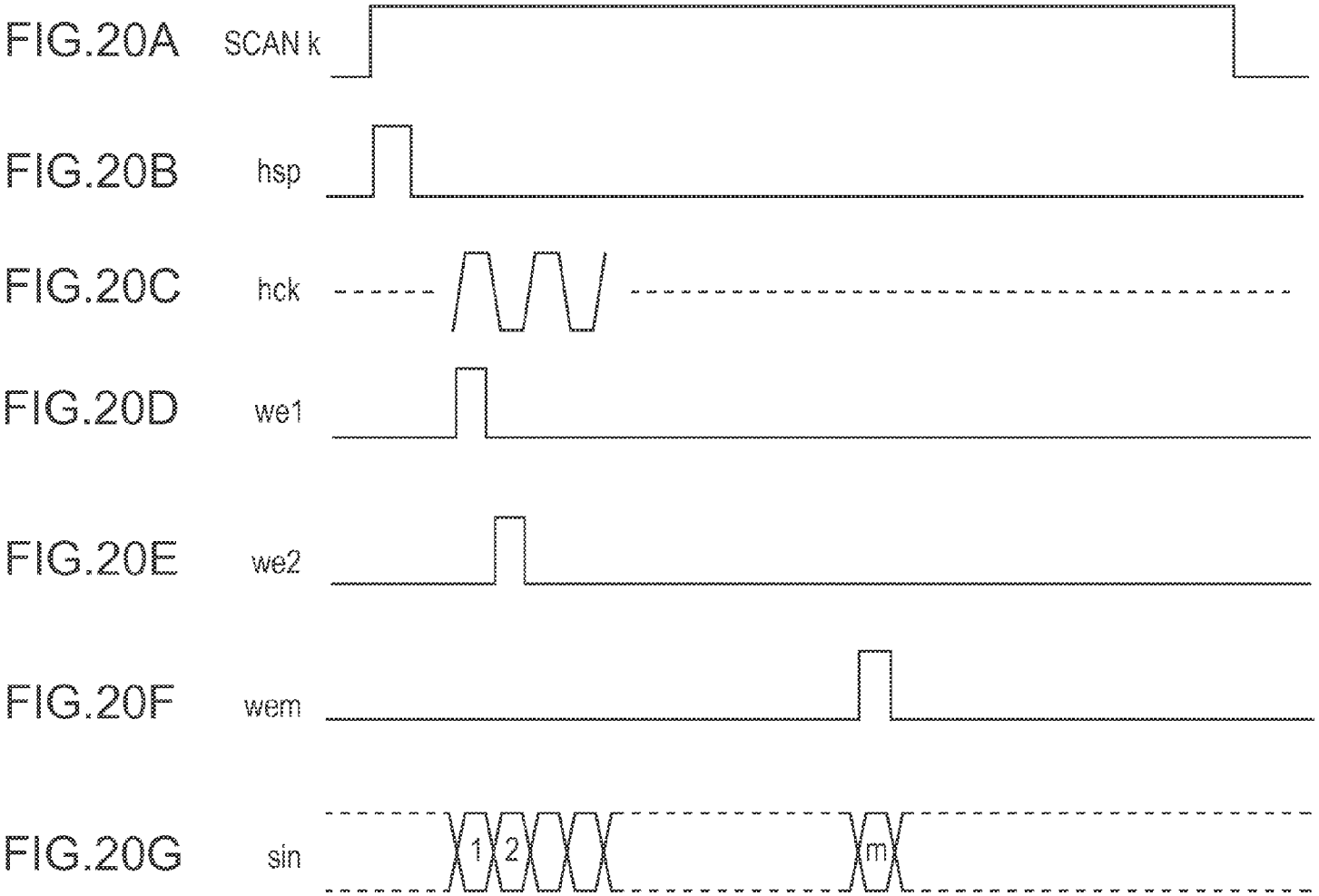
FIGS. 20A to 20G are timing diagrams illustrating the circuit operation of the sixth circuit example of the data line driver.

FIG. 19 is a circuit diagram showing a concrete circuit example of the voltage-programmed type current drivers 19-1 through **19-*m* forming the data line driving circuit 19. The current drivers 19-1 through 19-*m*** are identical to each other in circuit arrangement.

As seen from FIG. 19, the current driver according to the present example includes two TFTs 51 and 52, and a single capacitor 53. The TFT 51 is connected between a data line 13 and ground. The TFT 52 is connected between the gate of the TFT 51 and a signal input line 16. The capacitor 53 is connected between the gate of the TFT 51 and ground. In this circuit example, the TFTS 51 and 52 are NMOS type, however, the circuit is discussed for exemplary purposes only, and the present invention is not limited to this arrangement.

The feature of the current driver thus constructed lies in that a voltage source VS feeds luminance data sin through a signal input line 16 in the form of voltage. When a voltage Vw is applied to the signal input line 16 with a writing control signal we set to a selection state (at a high level) during writing the luminance data sin, the TFT 52 is turned on, causing the gate-source voltage Vgs of the TFT 51 to be the writing voltage Vw.

The writing voltage Vw is held in the capacitor 53 even when the writing control signal we shifts to a deselection state. With the TFT 51 operating in the saturation state thereof, the current Id flowing through the TFT 51 is expressed as follows:

$$Id=\mu CoxW/L/2(Vw-Vth)^2 \quad (18)$$

The driving current Id of the data line 13 is controlled by the writing voltage Vw.

FIGS. 20A to 20G illustrate a timing diagram of the operation of the active-matrix display device shown in FIG. 18 with the data line driving circuit 19 formed of the current driver, thud constructed. The operation of the active-matrix display device remains unchanged from that of the circuit shown in FIG. 1, and the discussion thereof is thus skipped.

Seventh Circuit Example

Figure 21:
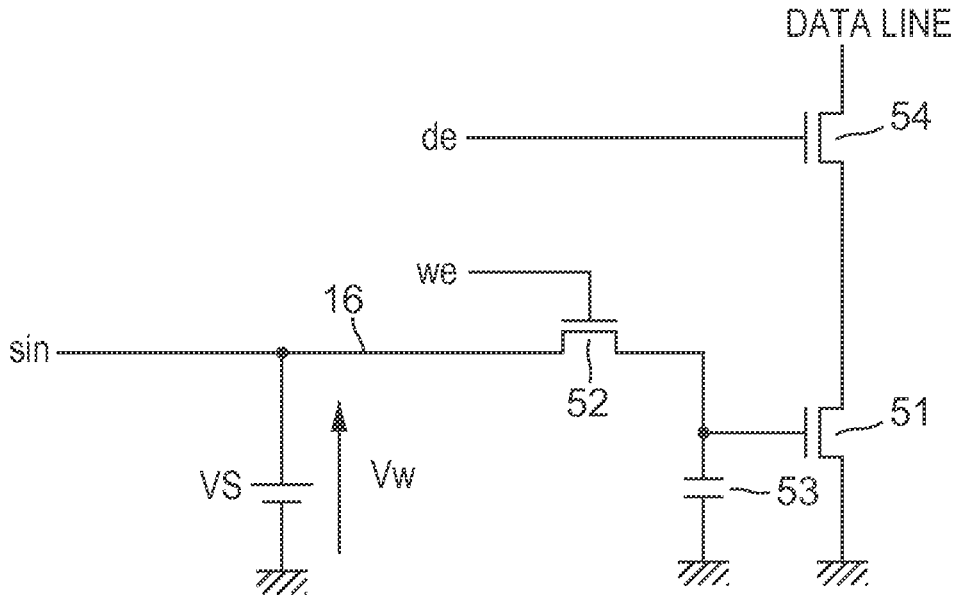
FIG. 21 is a timing diagram showing seventh circuit example of the data line driver.

FIG. 21 is a circuit diagram showing a concrete circuit example of the voltage-programmed-type current driver. In the figure, the same parts as those of FIG. 19 are indicated by the same symbols as those of FIG. 19. The current driver according to the present example is identical to the voltage-programmed-type current driver shown in FIG. 19 except that a TFT 54 to be controlled by a driving control signal de is added. The TFT 54 is connected between the data line 13 and the drain of a TFT 51 and receives the driving control signal de at the gate thereof. In this circuit example, the TFTs 51, 52 and 53 are NMOS type, however, this circuit is discussed for exemplary purposes only, and the present invention is not limited to this arrangement In this way, each of the active-matrix display devices shown in FIG. 1, FIG. 8, FIG. 11, and FIG. 12 can be produced using the current driver that includes the TFT 54, connected between the data line 13 and the drain of the TFT 51, to be controlled by the driving control signal de. In case of the active-matrix display devices shown in FIG. 8, FIG. 11, and FIG. 12, the two rows of data line drivers are employed, and the writing of the data line drivers and the driving of the data lines 13-1 through **13-*m*** are performed alternately. This arrangement permits a substantial time margin in operation times.

Eighth Circuit Example

FIG. 22 is a circuit diagram showing an another circuit example of the voltage-programmed-type current driver. In the figure, the same parts as those of FIG. 21 are indicated by the same symbols as those of FIG. 21. The current driver according to the present example includes, in addition to the circuit shown in FIG. 21, a reset TFT 57 connected between the gate and the drain of the TFT 51, and a data writing capacitor 58 connected between the gate of the TFT 51 and the source of the TFT 52.

In the circuit shown in FIG. 22, luminance data is given in the form of voltage and is held in the capacitor 53 as is. In response to the held voltage, the TFT 51 allows a current to flow through the data line. In the configuration, when the threshold value of the TFT 51 varies, the driving current varies in accordance with the equation (1), thereby degrading the quality of image on the screen.

In the voltage-programmed-type current driver according to the present circuit example, in contrast, the TFT 57 electrically shorts the gate and the drain of the TFT 51 for a predetermined duration of time, and the gate of the TFT 51 is then capacitively coupled to the signal input line 16 through the data writing capacitor 56. Even when the threshold value of the TFT 51 varies, the driving current is free from variations, and the image is not degraded. The operation of the current driver will be discussed referring to a timing diagram shown in FIGS. 23A to 23D.

When the TFT 54 is on, the TFT 57 is turned on in response to a high-level reset signal rst coming to the gate thereof. The gate and the drain of the TFT 51 are shorted. At this time, since the TFT 54 is on with a current flowing through the TFT 54 and the TFT 51 from the data line to the ground, the gate-source voltage Vgs of the TFT 51 becomes higher than the threshold value Vth of the TFT 51.

The driving control signal de given to the gate of the TFT 54 is driven low, thereby turning off the TFT 54. The current flowing through the TFT 51 becomes zero after a predetermined duration of time. Since the gate and the drain of the TFT 51 are shorted by the TFT 57, the potential of the drain and the gate of the TFT 51 is gradually lowered, and reaches a steady state at the threshold value Vth of the TFT 51. Since a high-level writing control signal we is applied to the gate of the TFT 52, the signal input line 16 is kept to a predetermined potential (a ground level here) (hereinafter this state is referred to as a reset operation). The writing voltage Vw is applied to the signal input line 16.

The gate of the TFT 51 is capacitively coupled to the signal input line 16 through the data writing capacitor 58. Let Co and Cd represent the capacitances of the capacitors 53 and 58, and the gate potential voltage of the TFT 51 rises by ΔVg as follows:

$$\Delta Vg = Vw \times Cd/(Cd+Co) \tag{19}$$

Since Vg=Vth prior to the application of the signal voltage Vw, the gate-source voltage Vgs of the TFT 51 is $$\begin{aligned} Vgs &= Vth + \Delta Vg \\ &= Vth + Vw \times Cd/(Cd+Co) \end{aligned} \tag{20}$$

(Hereinafter, this operation is referred to as a written operation.)

The TFT 52 is turned off subsequent to the application of the signal voltage VW. The TFT 54 is turned on in response to the driving control signal de coming to the gate thereof. The TFT 51 allows a current to flow through the data line. From the equations (1) and (20), that current Id is $$Id = \mu Cox\ W/L/2\{VW \times Cd/(Cd+Vo)\}^2 \tag{21}$$

(Hereinafter, this operation is referred to as a driving operation.) Since the equation (21) does not contain the threshold value Vth, the driving current Id is clearly free from variations in the threshold value Vth of the TFT 51.

Figure 24:
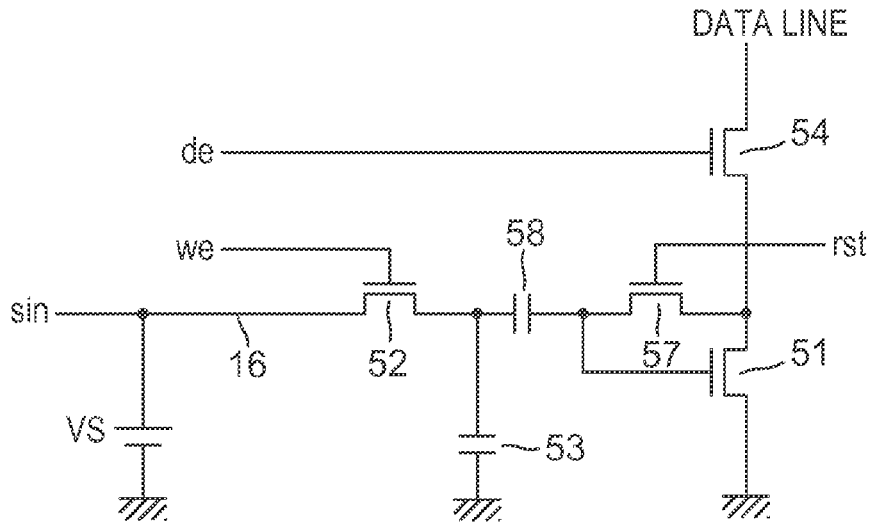
FIG. 24 is a circuit diagram showing a modification of the eighth circuit example of the data line driver.

FIG. 24 is a circuit diagram showing a modification of the eighth circuit example of the current driver. In the figure, the same parts as those of FIG. 22 are indicated by the same symbols as those of FIG. 22. The modification of the eighth circuit example includes the capacitor 53 connected between the input terminal of the data writing capacitor 58 and ground, in contrast to the eighth circuit example in which the capacitor 53 is connected between the output terminal of the data writing capacitor 58 and ground. The rest of the construction and the operation timing diagram remain unchanged.

As the capacitor 53 is connected between the input terminal of the data writing capacitor 58 and ground in this way, the gate-source voltage Vgs of the TFT 51 subsequent to the application of the signal voltage Vw becomes approximately Vth+Vw. In other words, given the same signal voltage Vw, a larger gate-source voltage Vgs results in comparison with the current driver according to the eighth circuit example.

Figure 25:
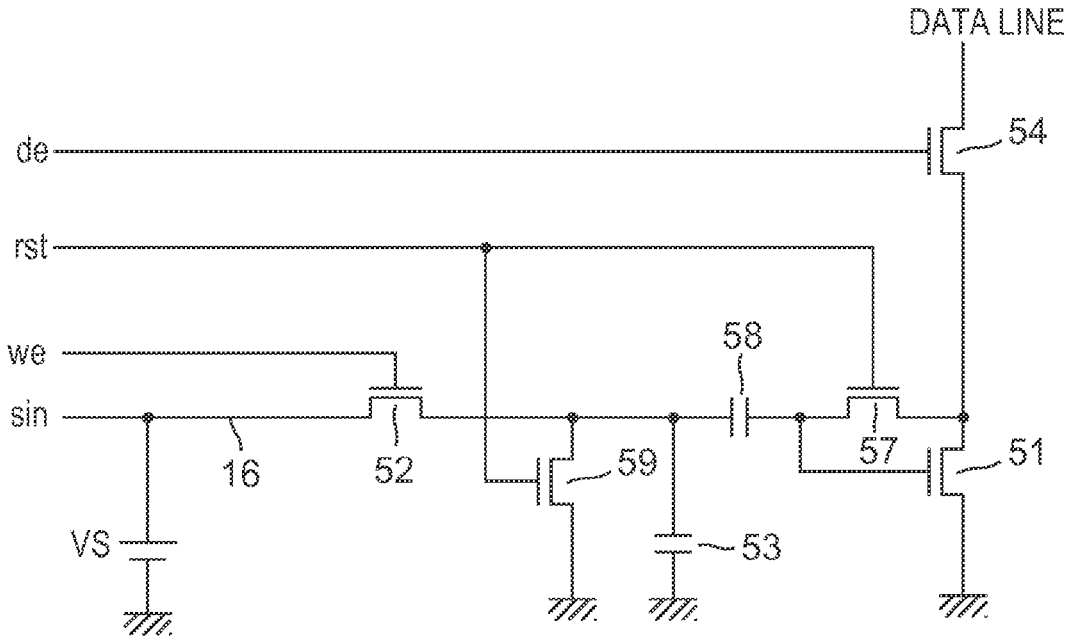
FIG. 25 is a circuit diagram showing another modification of the eighth circuit example of the data line driver.
Figures 26A, 26B, 26C, 26D:
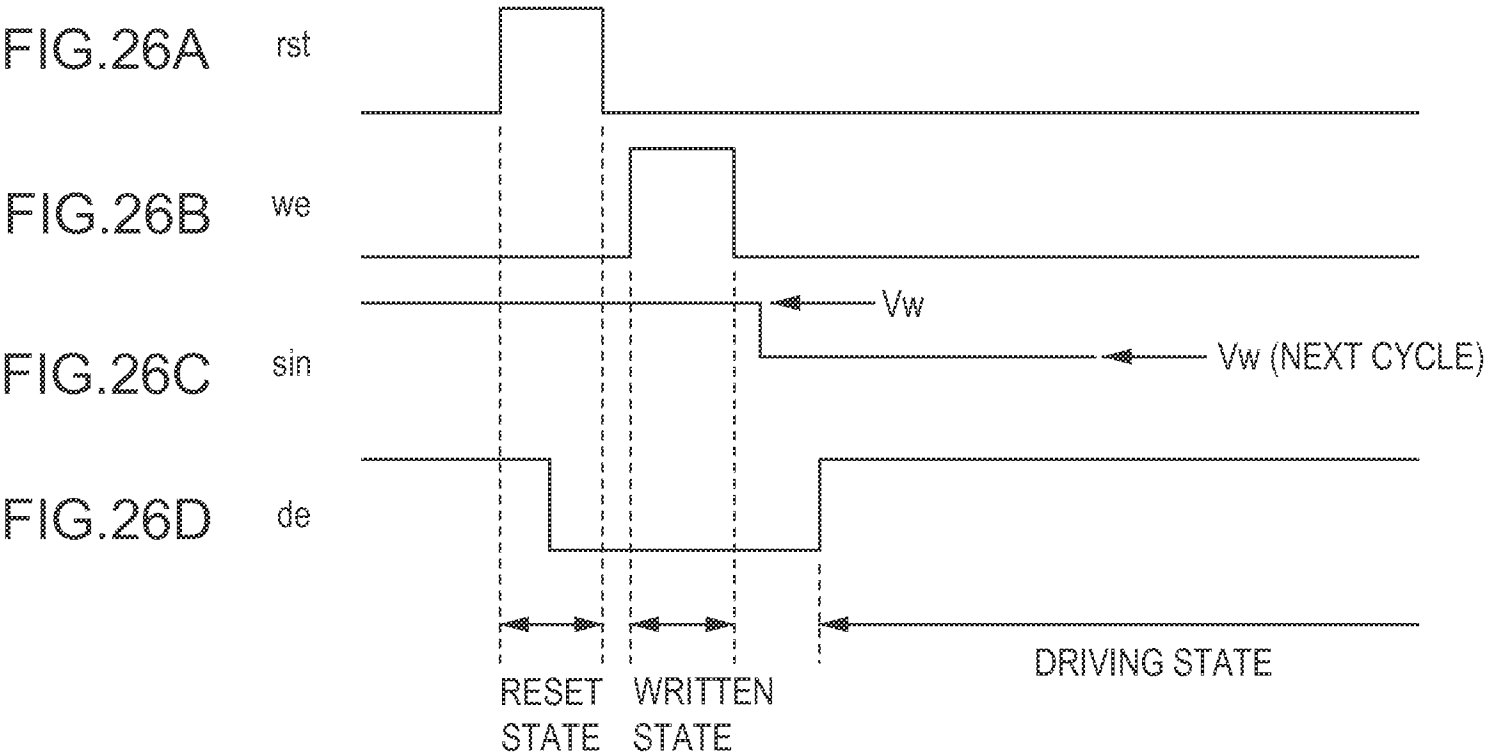
FIGS. 26A to 26D are timing diagrams illustrating the circuit operation of another modification of the eighth circuit example of the data line driver.

FIG. 25 is a circuit diagram showing yet another modification of the eighth circuit example. In the figure, the same parts as those of FIG. 24 are indicated by the same symbols as those of FIG. 24. The current driver according to the modification of the circuit example is different from the current driver shown in FIG. 24 in that a switching element, such as a TFT 59 is newly connected between the node of the data writing capacitor 58 with the signal input line and a point at a predetermined potential (a ground level here), and in the reset operation thereof.

The operation of the current driver according to the modification of the circuit example will now be discussed with reference to a timing diagram shown in FIGS. 26A to 26D. As the same way as in the circuit example of FIG. 24, upon receiving a high-level reset signal rst at the gate during the reset operation, the TFT 57 is turned on. The gate and the drain of the TFT 51 are thus electrically shorted to each other.

When the TFT 54 is turned off in response to the transition of the driving control signal de to a low level at the gate thereof, the gate and the drain of the TFT 51 becomes stabilized at the threshold value Vth thereof as the same way as in the circuit example of FIG. 24. The writing control signal we given to the gate of the TFT 52 remains at a low level, and the newly added TFT 59 is turned on in response to the reset signal rst. The potential of the drain of the TFT 59 is driven to a predetermined potential (a ground level in present example).

When the reset signal rst is driven low, the TFT 59 is turned off, and the writing control signal we is then driven high. The signal voltage VW, applied to the signal input line 16, is transferred to the gate of the TFT 51 t5 through the data writing capacitor 58. The gate-source voltage Vgs of the TFT 51 becomes approximately Vth+Vw as in the circuit shown in FIG. 24.

The current driver shown in FIG. 25 operates in substantially the same way as that shown in FIG. 24. The advantage of the current driver shown in FIG. 25 lies in that control of the voltage of the signal input line 16 is easy and that the writing speed becomes fast. Specifically, in the circuit shown in FIG. 24, the potential of the signal input line 16 needs to be controlled in the arrangement in which the capacitor 53 is reset to a reference potential (a ground level in the present example) through the signal input line 16 and the TFT 52 in the reset operation.

In contrast, the circuit shown in FIG. 25 does not need to provide a reference potential to the signal input line 16, because the TFT 59 easily resets the capacitor 53. The control of the signal input line 16 is thus facilitated. Referring to FIGS. 26A to 26D, the signal input line 16 may be set to any potential, for example, to a signal voltage for the next write cycle, subsequent to the writing of the signal voltage Vw to the current driver. The writing of the signal voltage Vw is thus quickly performed.

Fourth Embodiment

Figure 27:
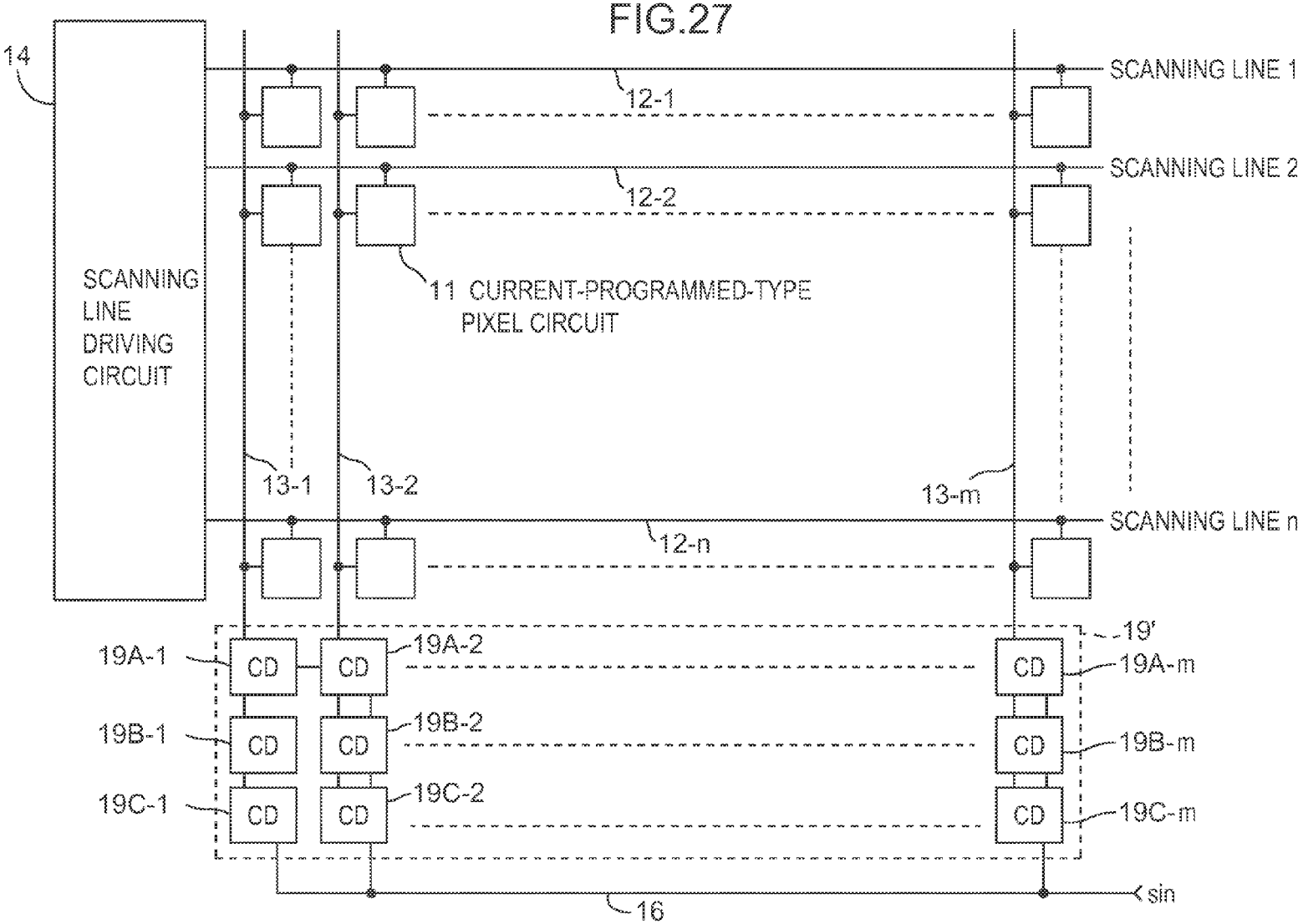
FIG. 27 is a block diagram showing an example of the configuration of an active-matrix display device according to a fourth embodiment of the present invention.

FIG. 27 is a block diagram showing an example of the configuration of an active-matrix display device according to a fourth embodiment of the present invention. In the figure, the same parts as those of FIG. 18 are indicated by the same symbols as those of FIG. 18. The active-matrix display device according to the present embodiment is different from the active-matrix display device of the third embodiment in the construction of the data line driving circuit 19'.

The active-matrix display device according to the third embodiment includes the single row of voltage-programmed-type current drivers (CDs) 19-1 through **19-*m* in the data line driving circuit 19. In contrast, the active-matrix display device according to the present embodiment includes three rows of voltage-programmed-type current drivers 19A-1 through 19A-m, 19B-1 through 19B-m, and 19C-1 through 19C-m in the data line driving circuit 19'**.

Employed as each of the three rows of voltage-programmed-type current drivers 19A-1 through 19A-m, 19B-1 through 19B-m, and 19C-1 through 19C-m is the eighth circuit example of the voltage-programmed-type current driver. The feature of the eighth circuit example is that the gate of the TFT 51 is capacitively coupled to the signal input line 16 subsequent to the electrically shorting action of the gate and the drain of the TFT 51 so that the driving current remains stabilized even with the threshold value of the TFT 51 varied.

Figures 28A, 28B, 28C:
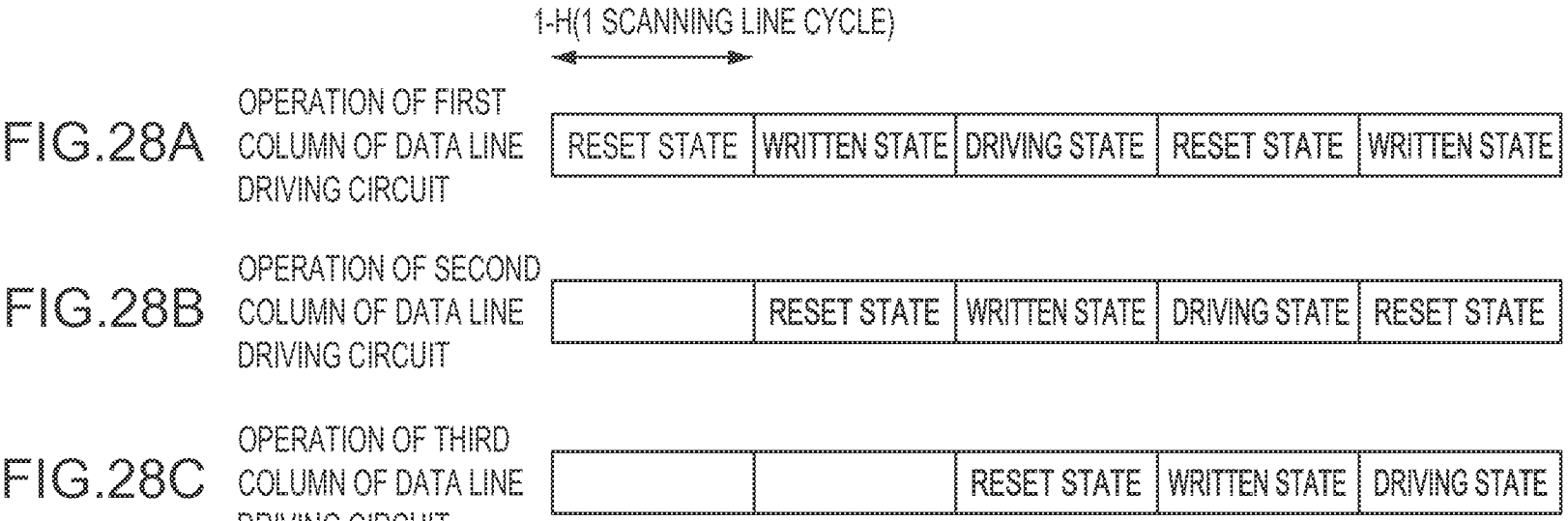
FIGS. 28A to 28C are views for explaining the operation of the active-matrix display device of the fourth embodiment.

The reason why the three rows of voltage-programmed-type current drivers are used for each data line is as follows. The current driver according to the eighth circuit example performs a required function by repeating a reset operation, a written operation, and a driving operation. The active-matrix display device according to the present embodiment thus switches the three operations every scanning line switching period so that a first row of the data line during circuits perform the reset operation, a second row performs the written operation, and a third row performs the driving operation as shown in FIGS. 28A to 28C.

In this way, the active-matrix display device repeats the three types of operations of resetting, being written, and driving through the voltage-programmed-type current drivers. The three rows of voltage-programmed-type current drivers are arranged for every data line. In a given scanning cycle, the first row of current drivers perform the reset operation, the second row of current drivers performs the written operation, and the third row of current drivers performs the driving operation. The active-matrix display device thus uses one scanning line switching period (1H) for each operation, thereby reliably performing each operation.

Fifth Embodiment

Figure 29:
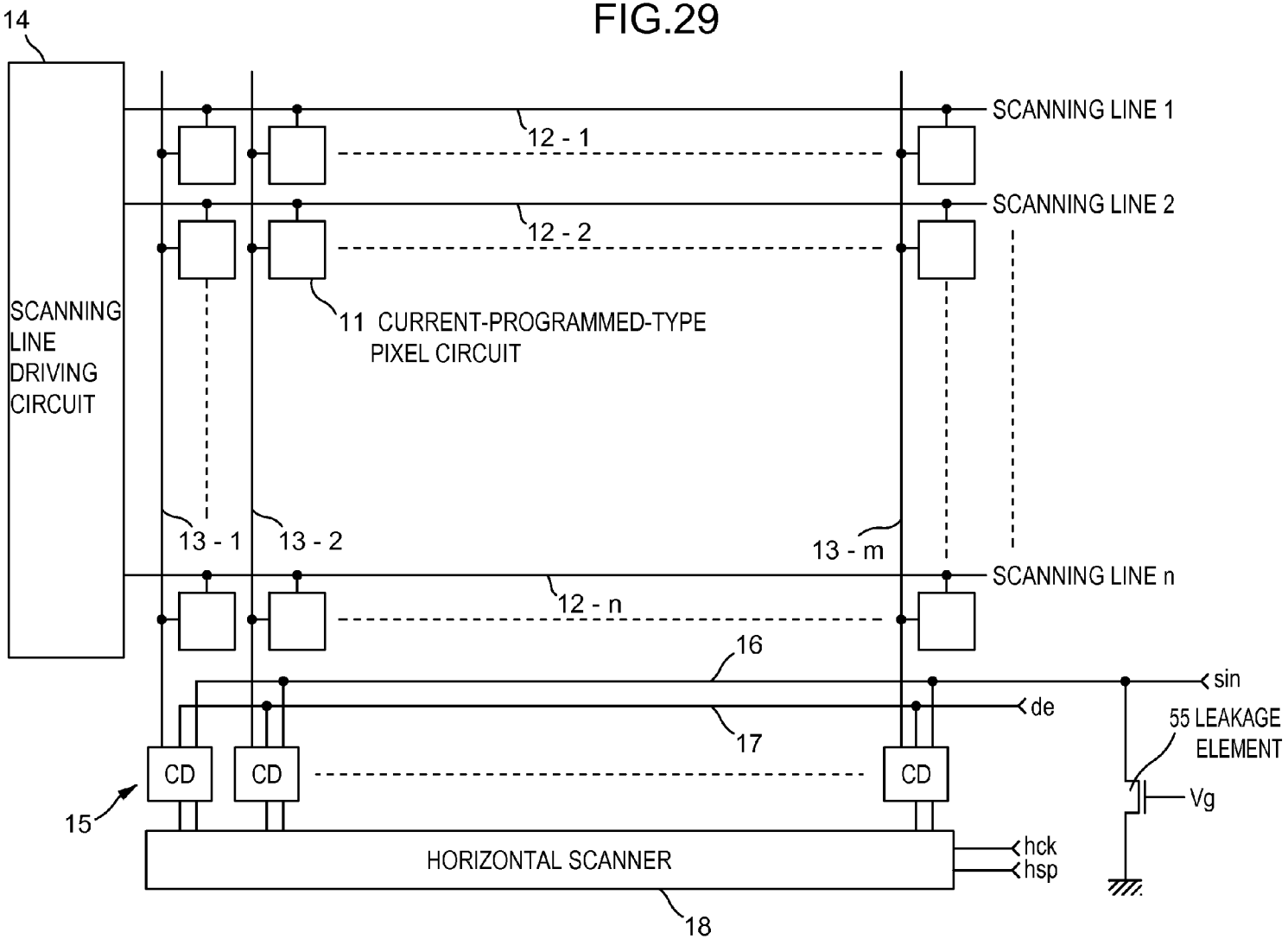
FIG. 29 is a block diagram showing an example of the configuration of an active-matrix display device according to a fifth embodiment of the present invention.

FIG. 29 is a block diagram showing an example of the configuration of an active-matrix display device according to a fifth embodiment of the present invention. In the figure, the same pasts as those of FIG. 1 are indicated by the same symbols as those of FIG. 1. The active-matrix display device according to the present embodiment is substantially identical to that of the first embodiment. The difference therebetween is that the active-matrix display device of the fifth embodiment is provided with a leakage (LK) element 55 of a NMOS transistor connected between a signal input line 16 and ground.

The operation of the leakage element 55 will now be discussed. The writing of a "black" level corresponds to zero current in a current-programmed-type pixel circuit. If a "white" level, i.e., a relatively large current has been written onto the signal input line 16 in an immediately preceding writing cycle, the potential of the signal input line 16 may be left to be at a relatively high level. It takes time for write a "black" level immediately subsequent to the white level.

Figure 30:
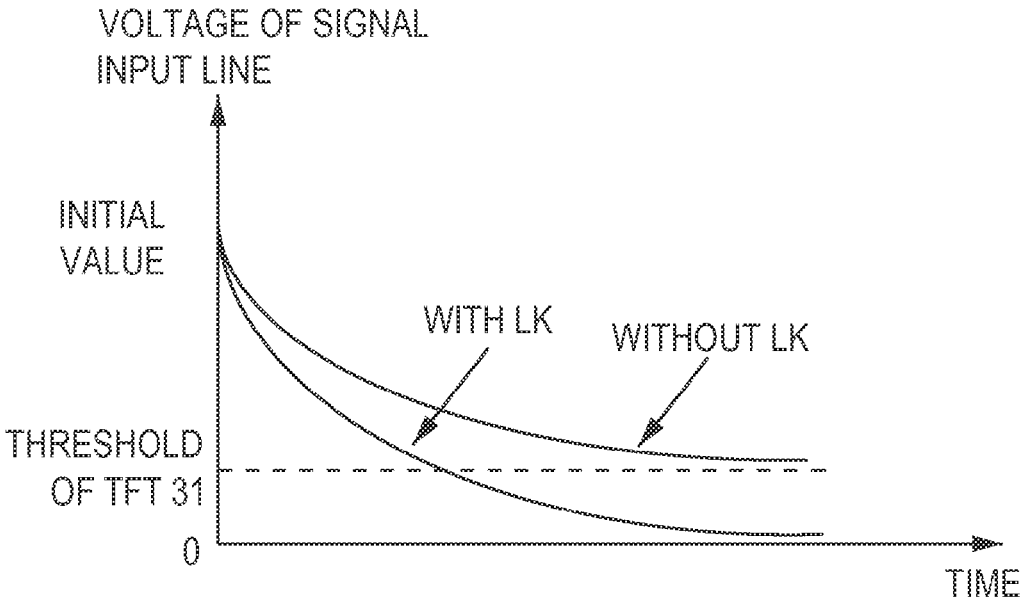
FIG. 30 is a view for explaining the effect of a leakage (LK) element in the active-matrix display device of the fifth embodiment.

The writing of the "black" level in the current driver shown in FIG. 4, for example, means that an initial charge stored in the capacitor Cs of the signal input line 16 is discharged through the TFT 31 with the voltage of the signal input line 16 becoming the threshold value of the TFT 31 as shown in FIG. 30. When the voltage of the signal input line 16 drops close to the threshold value of the TFT 31, impedance of the TFT 32 rises, and the writing of the "black" level theoretically never ends. In practice, however, the writing is performed within a finite time, and the black level ends not sinking down to the intended level thereof. This too-high brightness phenomenon degrades contrast of the display.

In contrast, the active-matrix display device according to the present embodiment includes the leakage element 55, namely, the NMOS transistor, between the signal input line 16 and a point at a predetermined potential (a ground potential, for example). The leakage element 55 is supplied with a constant bias as the gate voltage Vg thereof at the gate thereof. Referring to FIG. 30, the data line voltage drops at a relatively fast speed even in the vicinity of the threshold value of the TFT 31 during the writing of the black level, thereby avoiding the too-high brightness phenomenon.

The leakage element 55 may be a simple resistor. However, the data line potential rises during the writing of the "white" level, a current flowing through the resistor increases accordingly. This leads to a drop in current flowing through the TFT 31 or an increase in power consumption in the current driver shown in FIG. 4.

If the NMOS transistor as the leakage element 55 is set to operate in the saturation region thereof, the transistor works on a constant-current mode, and these disadvantages will be minimized. In another circuit arrangement, the gate potential may be controlled so that the NMOS transistor as the leakage element 55 may be turned on as necessary (during the writing of the black level, for example).

The circuit arrangement in which the leakage element 55 is connected between the signal input line 16 and ground is not limited to the active-matrix display device of FIG. 1 in which the current-programmed-type current driver shown in FIG. 4 is employed. This circuit arrangement may be applied to another current-programmed-type current driver or the active-matrix display device shown in FIG. 19 incorporating the voltage-programmed-type current driver. The leakage element 55 may be formed of a TFT or an external component manufactured in a process different from a TFT manufacturing process.

Sixth Embodiment

Figure 31:
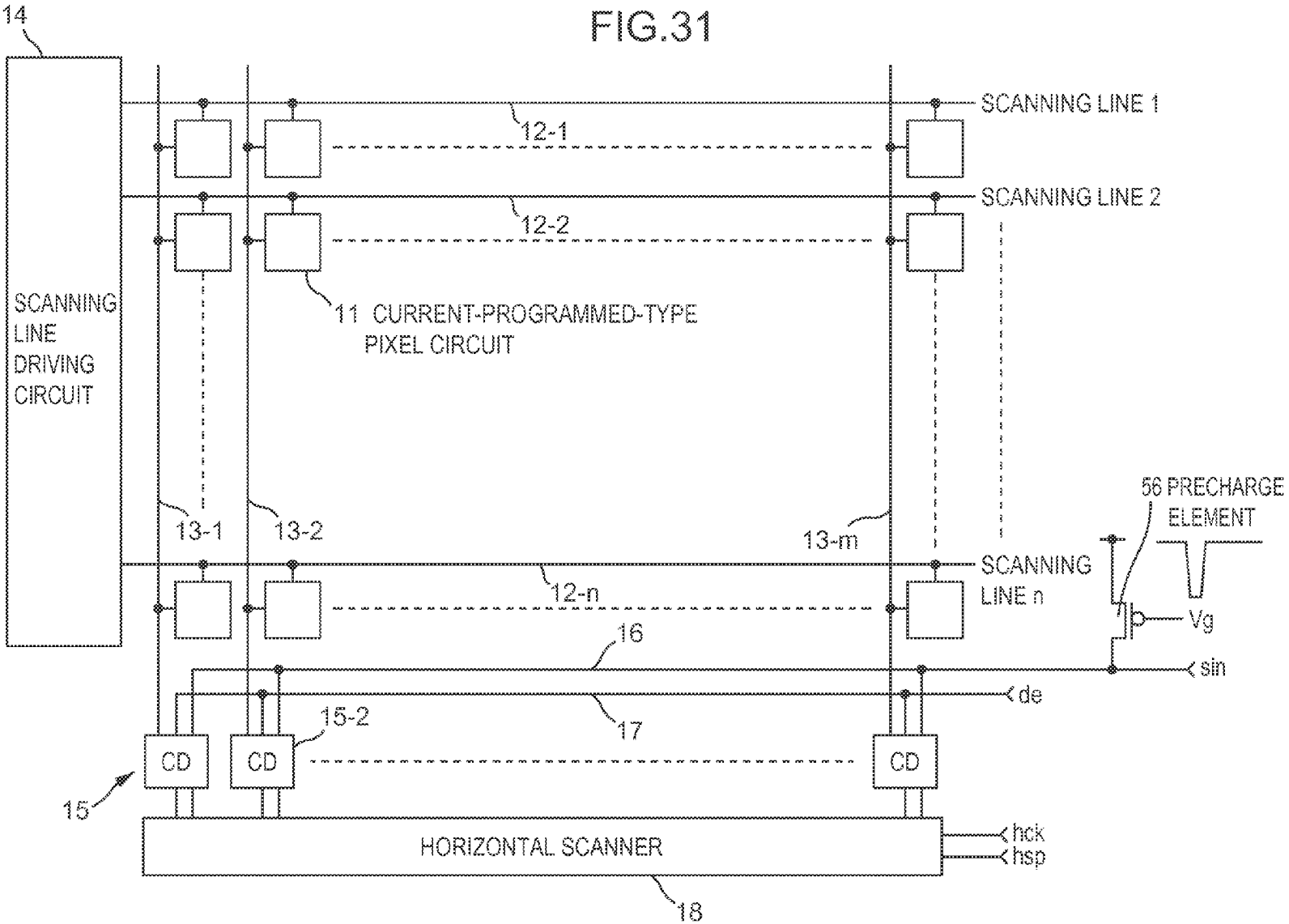
FIG. 31 is a block diagram showing an example of the configuration of an active-matrix display device according to a sixth embodiment of the present invention.

FIG. 31 is a block diagram showing an example of the configuration of an active-matrix display device according to a sixth embodiment of the present invention. In the figure, the same parts as those of FIG. 1 are indicated by the same symbols as those of FIG. 1. The active-matrix display device according to the present embodiment is basically identical in construction to that of the first embodiment. The active-matrix display device of the present embodiment includes, in addition to the construction of the first embodiment, a precharge element (PC) 56 of a PMOS transistor, as an initial value setting element, between the signal input line 16 and a positive power source Vdd.

Figure 32:
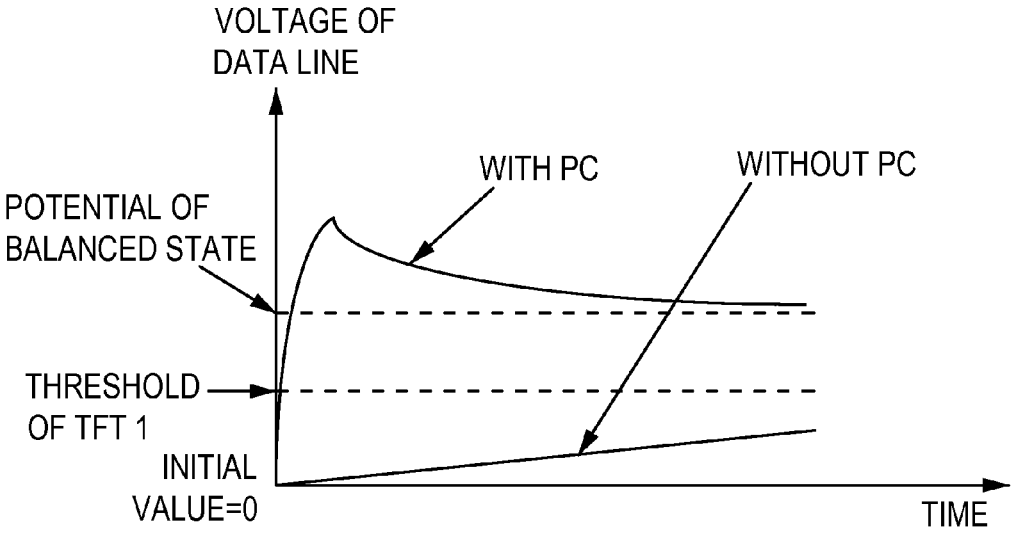
FIG. 32 is a view for explaining the effect of a precharge (PC) element in the active-matrix display device of the sixth embodiment.
Figure 33:
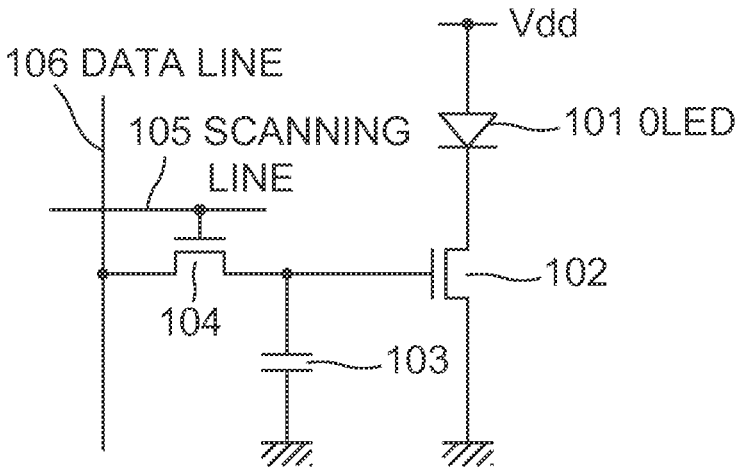
FIG. 33 is a circuit diagram showing a pixel circuit of a conventional art.
Figure 34:
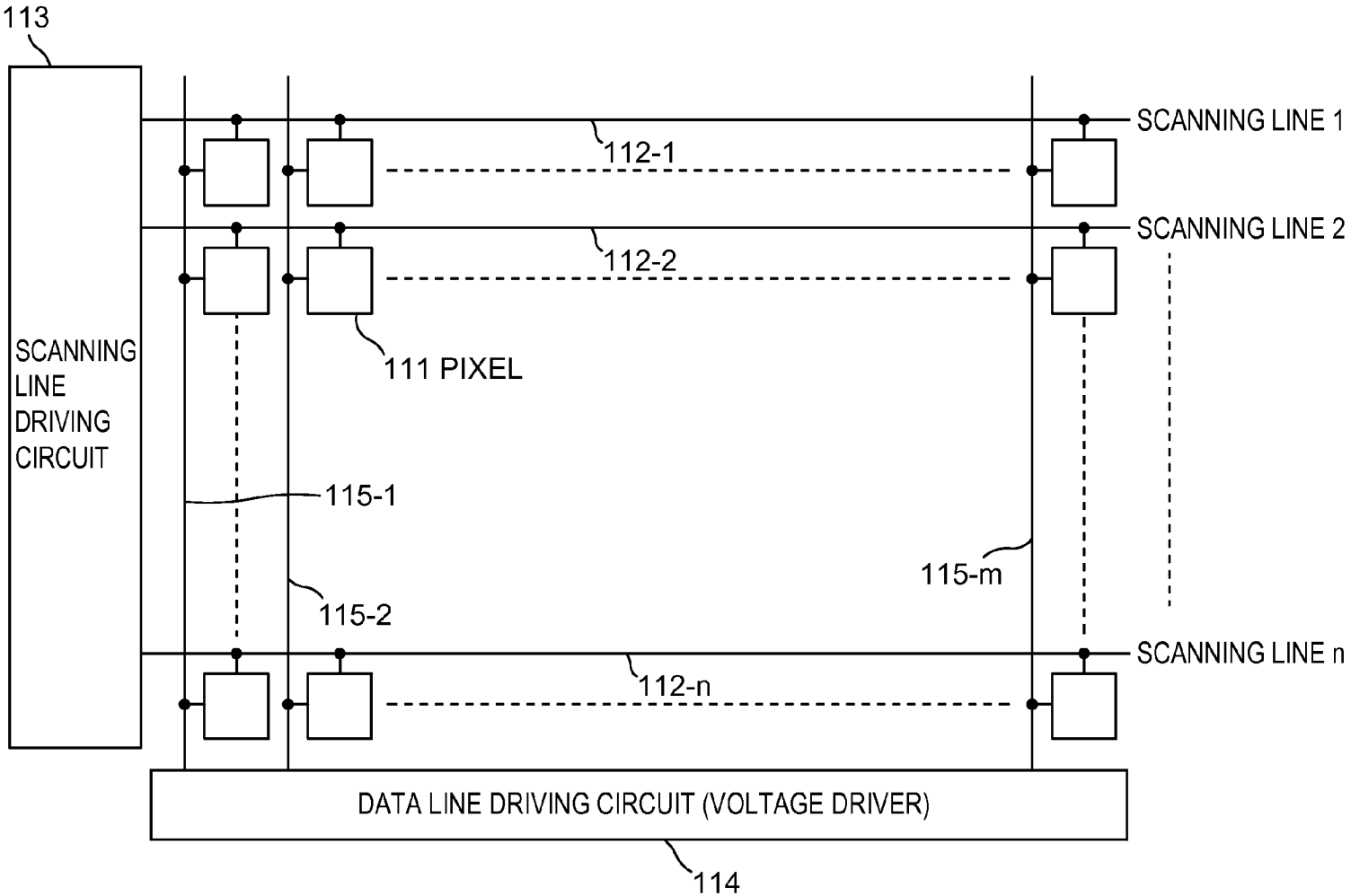
FIG. 34 is a block diagram showing the configuration of an active-matrix display device working on a line-by-line basis.

The operation of the precharge element 56 will now be discussed. There are times when it takes a long time to write a blackish gray level in a current-programmed-type pixel circuit. Referring to FIG. 32, the potential of the data line is zero at the start of the writing. This can occur when the "black" level has been written in the immediately preceding cycle, and the threshold value of the TFT 31 in the current driver (in FIG. 4, for example) is as low as zero volt or the black level is also now written, and the leakage element 55 for controlling the too-high brightness phenomenon is incorporated.

It takes time to reach a balanced voltage because a blackish gray, i.e., an extremely small current, starting with an initial value of zero, is written. It is considered that the voltage of the data line fails to reach the threshold Value of the TFT 31 within a predetermined time. In this case, the TFT 31 is turned off at the driving of the data line 13, thereby causing a too-low brightness phenomenon in the display.

In the active-matrix display device according to the present embodiment, the PMOS transistor as the precharge element 56 is connected between the data line 13 and the power source potential Vdd. The precharge element 56 is Supplied with a pulse as the gate voltage Vg at the start of a writing cycle. In response to the pulse, the voltage of the signal input line 16 rises above the threshold value of the TFT 31, and relatively fast reaches a balanced potential determined between the balance between the writing current Iw and the operation of the TFT in the data line driving circuit. Accurate luminance data writing is quickly performed.

The circuit arrangement in which the precharge element 56 is connected between the signal input line 16 and the positive power supply source Vdd is not limited to the active-matrix display device shown in FIG. 1 including the current-programmed-type current driver shown in FIG. 4. This circuit arrangement may be applied to an active-matrix display device incorporating another current-programmed-type current driver. The leakage element 55 may be formed of a TFT or an external component manufactured in a process different from a TFT manufacturing process.

The above-referenced embodiments have been discussed in connection with the active-matrix organic EL devices employing the organic EL element as a display element in the current-programmed-type pixel circuit 11. The present invention is not limited to this arrangement. The present invention is generally applied to active-matrix display devices which uses, as a display element, an electrooptical element that changes the luminance level thereof in response to a current flowing therethrough.

In each of the above-referenced circuit examples in each of the above embodiments, a first field-effect transistor as a converting unit for converting the writing current into a voltage and a second field-effect transistor as a driving unit for converting the voltage held in the capacitor (a holding unit) into a driving current to drive the data line are formed of different transistors. Alternatively, the same transistor may be used as the first and second field-effect transistors so that the current-to-voltage converting operation and the driving operation of the data line may be performed in a time sharing manner. With this arrangement, theoretically, no variations take place from operation to operation.

INDUSTRIAL APPLICABILITY

In accordance with the present invention, the active-matrix display device using the current-programmed-type pixel circuit holds the image information in the form of voltage, then converts the voltage into a current, and then drives the plurality of data lines (at a time). In this way, the image information is written on the pixel circuits. Since the image information is written on the pixel circuits on a line-by-line basis, the number of the connection points between the display panel and the data line driving circuit external to the display panel is reduced, and a current writing operation is reliably performed.

The invention claimed is:

1. A display device comprising:

a pixel element configured to emit light;

a current line coupled to the pixel element; and a driving circuit including a holding unit, a first transistor, a second transistor, a third transistor, a fourth transistor and a fifth transistor, wherein the holding unit is configured to hold a luminance data voltage corresponding to an image information signal, the third transistor and the fourth transistor are connected to the first transistor, and the fifth transistor is connected to the holding unit, and wherein the driving circuit is configured to operate such that:

a reset signal and the image information signal are sequentially written to the holding unit, via the fifth transistor and the second transistor, respectively, during a predetermined period;

the fourth transistor electrically connects a current node of the first transistor to a gate node of the first transistor;

the third transistor switches current flow on and off from the first transistor to the current line, and is set in an off state in at least a portion of the predetermined period; and the first transistor transforms the luminance data voltage in the holding unit into a current signal, the current signal being supplied to the pixel element through the current line.

2. The display device according to claim 1, wherein the predetermined period comprises a first period and a second period after the first period, and the driving circuit is configured to operate such that:

the reset signal is written to the holding unit via the fifth transistor in the first period, and the image information signal is written to the holding unit via the second transistor in the second period.

3. The display device according to claim 2, wherein the driving circuit is configured to operate such that the fourth transistor electrically connects the current node of the first transistor to a gate node of the first transistor in the first period.

4. The display device according to claim 2, wherein the second transistor is connected to a signal line for receiving the image information signal, and the driving circuit is configured to operate such that a voltage corresponding to the image information signal is applied to the signal line prior to the second period in which the second transistor is set in a conductive state.

5. The display device according to claim 1, wherein the driving circuit is configured to operate such that the fourth transistor electrically connects the current node of the first transistor to the gate node of the first transistor in the predetermined period such that the holding unit holds the luminance data voltage depending on a threshold voltage of the first transistor.

6. The display device according to claim 5, wherein the driving circuit is configured to operate such that the luminance data voltage depends on both of the image information signal and the threshold voltage, after the predetermined period.

7. The display device according to claim 1, wherein the second transistor is connected to a signal line for receiving the image information signal, and the driving circuit is configured to operate such that the fourth transistor electrically connects the current node of the first transistor to a gate node of the first transistor during a period in which a voltage corresponding to the image information signal is applied to the signal line.

8. The display device according to claim 1, wherein the pixel element includes a light emitting device, the light emitting device including a first electrode, a second electrode and an organic layer configured to emit light, and the organic layer is disposed between the first and the second electrodes.

9. The display device according to claim 8, wherein the pixel element further includes a pixel driving circuit having at least one transistor, associated with the light emitting device.

10. The display device according to claim 9, wherein the pixel driving circuit is a current-programmed-type pixel circuit.

11. The display device according to claim 1, wherein the third transistor is connected between the first transistor and the current line.

12. The display device according to claim 1 further comprising a display panel on which a plurality of the pixel elements are disposed in a matrix form, and wherein the driving circuit is associated with at least one of the pixel elements.

13. The display device according to claim 1, wherein the holding unit includes a first capacitor connected to a predetermined potential line, and a second capacitor connected to the gate node of the first transistor.

14. The display device according to claim 13, wherein the holding unit includes a first capacitor connected to a predetermined potential line, and a second capacitor connected to the gate node of the first transistor.

15. A voltage-current converter circuit suitable for a self-luminance display device, the voltage-current converter circuit comprising a holding unit, a first transistor, a second transistor, a third transistor, a fourth transistor and a fifth transistor;

the holding unit configured to hold a luminance data voltage corresponding to an image information signal;

the third transistor and the fourth transistor being connected to the first transistor; and the fifth transistor being connected to the holding unit;

wherein the voltage-current converting circuit is configured to operate such that:

a reset signal and the image information signal are sequentially written to the holding unit, via the fifth transistor and the second transistor, respectively, during a predetermined period;

the fourth transistor electrically connects a current node of the first transistor to a gate node of the first transistor;

the third transistor switches current flow on and off from the first transistor to a current line for outputting a current signal associated with luminance intensity of a light emitting device, and is set in an off state in at least a portion of the predetermined period; and the first transistor transforms the luminance data voltage in the holding unit into the current signal.

16. The voltage-current converter circuit according to claim 15, wherein the predetermined period comprises a first period and a second period after the first period, and the driving circuit is configured to operate such that:

the reset signal is written to the holding unit via the fifth transistor in the first period, and the image information signal is written to the holding unit via the second transistor in the second period.

17. The voltage-current converter circuit according to claim 16, wherein the driving circuit is configured to operate such that the fourth transistor electrically connects the current node of the first transistor to a gate node of the first transistor in the first period.

18. The voltage-current converter circuit according to claim 16, wherein the second transistor is connected to a signal line for receiving the image information signal, and the driving circuit is configured to operate such that a voltage corresponding to the image information signal is applied to the signal line prior to the second period in which the second transistor is set in a conductive state.

19. The voltage-current converter circuit according to claim 15, wherein the driving circuit is configured to operate such that the fourth transistor electrically connects the current node of the first transistor to the gate node of the first transistor in the predetermined period such that the holding unit holds the luminance data voltage depending on a threshold voltage of the first transistor.

20. The voltage-current converter circuit according to claim 15, wherein the driving circuit is configured to operate such that the luminance data voltage depends on both of the image information signal and the threshold voltage, after the predetermined period.

21. The voltage-current converter circuit according to claim 15, wherein the voltage-current converter circuit is suitable for a current-programmed-type pixel circuit.

22. The voltage-current converter circuit according to claim 15, wherein the third transistor is connected between the first transistor and the current line.

23. A display device comprising:

a plurality of self-emitting pixel elements arranged in a matrix form; and a plurality of the voltage-current converter circuits according to claim 15;

wherein each of the voltage-current converter circuits is respectively associated with at least corresponding one of the self-emitting pixel elements.

24. The display device according to claim 23, wherein two or more voltage-current converter circuits of the plurality of the voltage-current converter circuits are connected commonly to a signal line, and the signal line is configured to supply the image information signal to each of the two or more voltage-current converter circuits in a time-divisional manner.

25. The display device according to claim 24, further comprising a leakage element connected between the signal line and a predetermined potential line.

26. The display device according to claim 24, further comprising a pre-charge element connected between the signal line and a predetermined potential line.

27. The display device according to claim 23, wherein each of the voltage-current converter circuits are formed on a glass substrate.

28. The display device according to claim 27, wherein each of the voltage-current converter circuits are formed by employing poly-silicon TFTs.

* * * * *